United States Patent [19]

Strong

[11] Patent Number: 4,622,877

[45] Date of Patent: Nov. 18, 1986

[54] INDEPENDENTLY CONTROLLED WAVETABLE-MODIFICATION INSTRUMENT AND METHOD FOR GENERATING MUSICAL SOUND

[75] Inventor: Alexander R. Strong, Willington, Conn.

[73] Assignee: The Board of Trustees of the Leland Stanford Junior University, Palo Alto, Calif.

[21] Appl. No.: 743,563

[22] Filed: Jun. 11, 1985

[51] Int. Cl.[4] ..... G10H 1/00

[52] U.S. Cl. ..... 84/1.01; 84/1.28

[58] Field of Search ..... 84/1.01, 1.03, 1.28; 381/32; 369/60, 174

[56] References Cited

U.S. PATENT DOCUMENTS

| | | | |
|---|---|---|---|
| 3,816,664 | 6/1974 | Koch | 381/82 |
| 3,934,094 | 1/1976 | Kobayashi et al. | 381/82 |
| 4,338,843 | 7/1982 | Wise | 84/1.01 |
| 4,484,506 | 11/1984 | Sato | 84/1.01 |

*Primary Examiner*—William M. Shoop, Jr.
*Assistant Examiner*—Sharon D. Logan
*Attorney, Agent, or Firm*—Fliesler, Dubb, Meyer & Lovejoy

[57] ABSTRACT

A musical instrument for producing musical sound including a wavetable for storing a plurality of samples in wavetable locations. An address generator addresses wavetable locations for selecting stored samples to provide audio output signals and for selecting stored samples to be modified and restored. New addresses for specifying wavetable locations are provided employing a modification operation independent from an output operation.

66 Claims, 7 Drawing Figures

INDEPENDENTLY CONTROLLED WAVETABLE-MODIFICATION INSTRUMENT AND METHOD FOR GENERATING MUSICAL SOUND

CROSS-REFERENCED TO RELATED APPLICATION

WAVETABLE-MODIFICATION INSTRUMENT AND METHOD FOR GENERATING MUSICAL SOUND, Ser. No. 614,404 filed May 24, 1984.

BACKGROUND OF THE INVENTION

This invention relates to musical instruments and more specifically to digitally controlled electronic instruments and methods for generating musical sound.

Digitally controlled methods of generating musical sound operate by producing a sequence of digital numbers which are converted to electrical analog signals. The analog signals are amplified to produce musical sound through a conventional speaker. Musical instruments which employ digital control are constructed with a keyboard or other input device and with digital electronic circuits responsive to the keyboard. The electronic circuits digitally process signals in response to the keyboard and digitally generate oscillations which form the sound in the speaker. These digitally generated oscillations are distinguished from oscillations generated by analog oscillators and are distinguished from mechanically induced oscillations produced by conventional orchestral and other type instruments.

All musical sounds, whether of electronic or mechanical origin, can be described by Fourier spectrum. The Fourier spectra describes musical sound in terms of its component frequencies which are represented as sinusoids. The whole musical sound is, therefore, a sum of the component frequencies, that is, a sum of sinusoids.

Under Fourier analysis, tones are classified as harmonic or inharmonic. A harmonic tone is periodic and can be represented by a sum of sinusoids having frequencies which are integral multiples of a fundamental frequency. The fundamental frequency is the pitch of the tone. Harmonic instruments of the orchestra include the strings, the brasses, and the woodwinds. An inharmonic tone is not periodic, although it often can be represented by a sum of sinusoids. The frequencies comprising an inharmonic tone, however, usually do not have any simple relationship. Inharmonic instruments do not normally have any pitch associated with them. Instruments in the orchestra that are inharmonic include the percussion instruments, such as the bass drum, the snare drum, the cymbal and others.

Electronically controlled musical instruments have relied upon forming selected Fourier spectra as a basis for producing musical sound. One known type of digital musical instrument employs an harmonic summation method of music generation. In the harmonic summation method, a tone is produced by adding (or subtracting) a large number of amplitude-scaled sinusoids of different frequencies. The harmonic summation method, therefore, requires a large number of multiplications and additions to form each sample. That process requires digital circuitry which is both expensive and inflexible. Accordingly, the digital design necessary to carry out the method of harmonic summation is computationally complex and leaves much to be desired.

Another known type of musical instrument employs the filtering method of music generation. In the filtering method, a complex electrical waveform, such as a square wave or a saw-tooth pulse train, is filtered by one or more filters to select the desired frequency components. Thereafter, the filtered frequency components are combined to form the electrical signal which drives the speaker. The filtering method is commonly used to synthesize human speech and has often been used with analog electronic organs. The filtering method is comparatively inflexible since each sample relies upon the stored values of fixed samples. In order to achieve natural sound, the filtering method requires a large number of multiplication steps which are economically expensive to achieve. An example of music generation employing such complex multiplications appears in the Niimi patent ELECTRONIC MUSICAL INSTRUMENT UTILIZING DATA PROCESSING SYSTEM, U.S. Pat. No. Re. 31,004, and in the Niimi patent ELECTRONIC MUSICAL INSTRUMENT UTILIZING RECURSIVE ALGORITHM, U.S. Pat. No. 4,133,241.

In a typical example of a filter technique, a waveshape memory provides digital samples of one cycle of a waveshape to a loop circuit which includes a filter and a shift register. The digital waveshape samples read out from the wavshape memory are caused to circulate at a predetermined rate of time in the loop circuit. An output from the loop circuit varies as time lapses, and is utilized as a musical tone. An example of the circulating waveshape memory is the Niimi patent entitled ELECTRONICAL MUSICAL INSTRUMENT HAVING FILTER-AND-DELAY LOOP FOR TONE PRODUCTION, U.S. Pat. No. 4,130,043.

The classical filter techniques result in systems in which the pitch frequency $f_s/N$, is determined by division using an integer, N, and hence desirable variations due to non-integral division are not achieved.

In many prior art systems, the divisor, N, is forced to be an integer when shift-register or other fixed circuits are employed. Also, the integer is further limited to some power of 2 in order to facilitate processing. In order to vary the pitch, $f_s/N$, the frequency $f_s$ must be varied. Such systems, however, cannot be extended readily and economically to multivoice embodiments because, for example, each voice requires a different frequency, $f_s$.

Both the harmonic summation and the filtering methods rely upon a linear combination of sinusoids and, hence, they are characterized as linear methods for generating musical sound. The linear property is apparent from the fact that when the amplitude of the input function (sinusoids for harmonic summation or a pulse train for filtering) is multiplied by a factor of two, the result is an output waveform with the same tone quality and with an amplitude multiplied by a factor of two.

U.S. Pat. No. 4,018,121 entitled METHOD OF SYNTHESIZING A MUSICAL SOUND to Chowning describes a non-linear method for generating musical sound. That nonlinear method employs a closed-form expression (based upon frequency modulation) to represent the sum of an infinite number of sinusoids. That non-linear frequency modulation method produces a number of sinusoids which have frequencies which are the sum of the carrier frequency and integral multiples of the modulation frequency. The amplitudes of the multiples of the modulation frequency are sums of Bessel functions. The non-linear frequency modulation method of Chowning is an improvement over previously used linear harmonic summation and filtering methods, and has found commercial application in music synthesizers.

U.S. Pat. No. 4,215,617 entitled "MUSICAL INSTRUMENT AND METHOD FOR GENERATING MUSICAL SOUND" to Moorer describes improved non-linear methods of musical and sound generation in which the amplitudes of frequency components are not constrained to the Bessel functions and in which finite spectra can be utilized, that is, spectra composed of the sum of a finite number of sinusoids.

U.S. Pat. No. 4,130,043 entitled ELECTRONIC MUSICAL INSTRUMENT HAVING FILTER-AND-DELAY LOOP FOR TONE PRODUCTION to Niimi describes a classical filter operation which receives a single input from a "delay means" (wavetable). In that patent, the pitch frequency is limited to a constant, N, and cannot be readily changed in a multi-voice embodiment since in the patent the pitch is changed by changing the clock frequency. Furthermore, in the Niimi patent, an initial input of the waveshape which defines a period of a tone wave to be generated is required.

In general, prior art methods of musical sound generation have employed deterministic techniques. Typically, the methods rely upon an input sample which has fixed parameters which specify the musical sound to be generated. Such input samples when processed by a predetermined method result in a deterministic output signal which does not have the rich, natural sound of more traditional instruments.

While many linear and non-linear methods, like those described above, have been used with success for digital musical synthesis, they all have required fast and complex computational capability typically involving several multiplication steps per sample in order to achieve rich, natural sounds. Such fast and complex computational capability results in musical instruments of high cost and complexity. This high cost and complexity has impeded the widespread availability of economical digital synthesis.

Accordingly, there is a need for improved musical instruments employing digital synthesis which can be used with digital circuits requiring slower and less complex computational capability than that required by prior techniques, but which still produce rich and natural sounds. There is also a need for improved digital music synthesizers which can be constructed using conventional computer processors and conventional semiconductor chip technology.

Part of the need for improved musical instruments is satisfied by the above-identified cross-referenced application. That invention is a musical instrument and method employing probabilistic wavetable-modification for producing musical sound. The musical instrument includes a keyboard or other input device, a wavetable-modification generator for producing digital signals by probabilistic wavetable modification, and an output device for converting the digital signals into musical sound.

The generator in the above-identified cross-referenced application includes a wavetable which is periodically accessed to provide an output signal which determines the musical sound. The wavetable output signal, $y_t$, from the wavetable is provided as the audio output. Also, the wavetable output signal can be modified and stored back into the wavetable. A decision is made stochastically whether to modify the output signal before it is stored back into the wavetable. At some later time, the possibly modified signal which has been stored is again accessed and thereby becomes a new wavetable output signal. This process is repeated whereby each new output signal is stored (after possibly being modified) back into the wavetable. The output signals are thus generated by probabilistic wavetable modification and produce rich and natural musical sound.

The operation of the above-identified cross-referenced application is described as follows. At any time t, the signal $y_t$ which is stored back into the wavetable is a function of the result $v_t$ of accumulated modifications of the original contents $x_t$ of the wavetable, and a current modification component $m_t$. Therefore, the signal $y_t$ is a function of $v_t$ and $m_t$. In a digital sample embodiment, the $n^{th}$ sample of $y_t$ is given as $y_n$. In general, the $n^{th}$ modification component, $m_n$, is determined stochastically for each sample. For a particular sample n, $m_n$ may be such that no modification is performed. In accordance with one embodiment of the type suitable for generating plucked-string sounds, the modification performed to generate $y_n$ is an average of a first delayed output $y_{n-N}$ and the previous delayed output $y_{n-(N+1)}$. The location of data in the wavetable, in one digital memory embodiment, is determined by memory address pointers. A Read Pointer specifies the location of the delayed sample, $y_{n-N}$. A "Read Pointer+1" is offset from the Read Pointer by one and specifies the location of the delayed sample $y_{n-(N+1)}$. The modified value, $y_n$, is stored into the wavetable at a location specified by a Write Pointer. The Write Pointer is offset from the Read Pointer by the pitch number, N. In a multi-voice embodiment, the pitch number, N, is typically different for each voice. A Read Pointer and a Write Pointer are determined for each voice.

In the above-identified cross-referenced application, the $n^{th}$ word in the wavetable is initially set as $w_n = Au_n$ where A is some amplitude and $u_n$ is either +1 or −1 according to the output of a random bit generator (the probability of + as opposed to − could also be specified). This operation has the effect of initializing the waveform with white noise such that all Fourier frequency components are more or less equal in energy.

In the above-identified cross-referenced application, the parameters associated with a particular voice were not stored in the same memory containing the wavetables. Instead, these parameters were stored in a shift register of fixed length (16 stages). The voice bits were the low-order bits of the memory address, and a common write-pointer address was used for all the voices both for modification and for audio output to a digital-to-analog converter (DAC). In that embodiment, the 16-voice restriction tended to make the embodiment inflexible and such inflexibility should be avoided when possible.

In accordance with the above background, it is an objective of the present invention to provide an improved musical instrument and method of generating rich and natural musical sounds utilizing simple, flexible and conventional digital circuitry which does not require computational complexity.

SUMMARY OF THE INVENTION

The present invention is a musical instrument for producing musical sound. An input device specifies music to be generated. A wavetable generator generates digital samples of the music to be produced. The generator includes a wavetable for storing a plurality of samples in wavetable locations. An address generator addresses wavetable locations for selecting stored values to provide audio output signals and for selecting stored values to be modified. New addresses for specifying wavetable locations are provided employing a modification operation and an output operation.

The modification operation (K operation) employs a modification pointer for pointing to one of the wavetable locations and employs a modification operator for periodically changing the modification pointer. The output operation (J operation) employs an output pointer for pointing to one of the wavetable locations and employs an output operator for periodically modifying the output pointer. The modification and output pointers are independently controlled by the modification and output operators so that the pointers may change at different rates.

The frequency of providing audio output signals is $f_s$, the frequency of changing the output pointer is $f_J$, the frequency of changing the modification pointer is $f_K$ where $f_s$, $f_J$ and $f_K$ typically are all equal.

The musical instrument typically contains L locations wherein the values of data stored in the L locations are $w_i$, where i ranges from 0 to $L-1$. The output pointer J points to one of the wavetable locations 0 through $L-1$ and the modification pointer K points to one of the wavetable locations 0 through $L-1$. An output operator, $D_J$, periodically operates upon pointer J to possibly change the particular one of the locations pointed to by J and the second operator, $D_K$, periodically changes the particular one of the locations 0 through $L-1$ pointed to by the K pointer.

The present invention is particularly useful for multivoice embodiments, where each voice, g, has $L_G$ locations in a corresponding wavetable. The modification operation and the audio-output operation for each voice are independently controllable for great flexibility.

In the present invention, the operators have a random component which is controllable for inserting randomness into the generation of samples for audio-output or for modification back into the wavetable. Randomness helps, among other things, to prevent phase-locking.

The present invention includes means for generating an initial loading of the wavetable based on random number generation.

A probability factor, p, for controlling the probability of the state of the bits initially loaded into the wavetable thereby controlling the pink noise level, that is the pinkness, which determines the frequency distribution of the initial energy burst.

The present invention includes the ability to coalesce one or more voice locations in the wavetable into a single voice whereby higher frequency responses are possible.

The foregoing and other objects, features and advantages of the invention will be apparent from the following more particular description of preferred embodiments of the invention as illustrated in the accompanying drawings.

DETAILED DESCRIPTION

General

Figure 1:
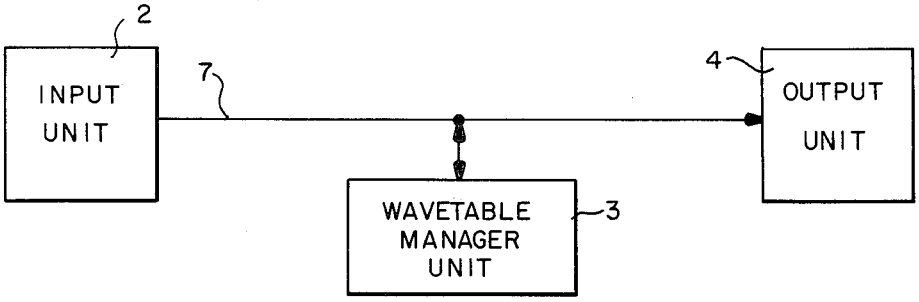
FIG. 1 depicts an electrical block diagram of a musical instrument incorporating the present invention.

In FIG. 1, a digital synthesizer musical instrument is shown. The instrument includes an input unit 2 which specifies a musical sound to be generated, a wavetable-manager unit 3 for generating signals representing the sound to be produced and an output unit 4 for producing the desired sound.

Figure 2:
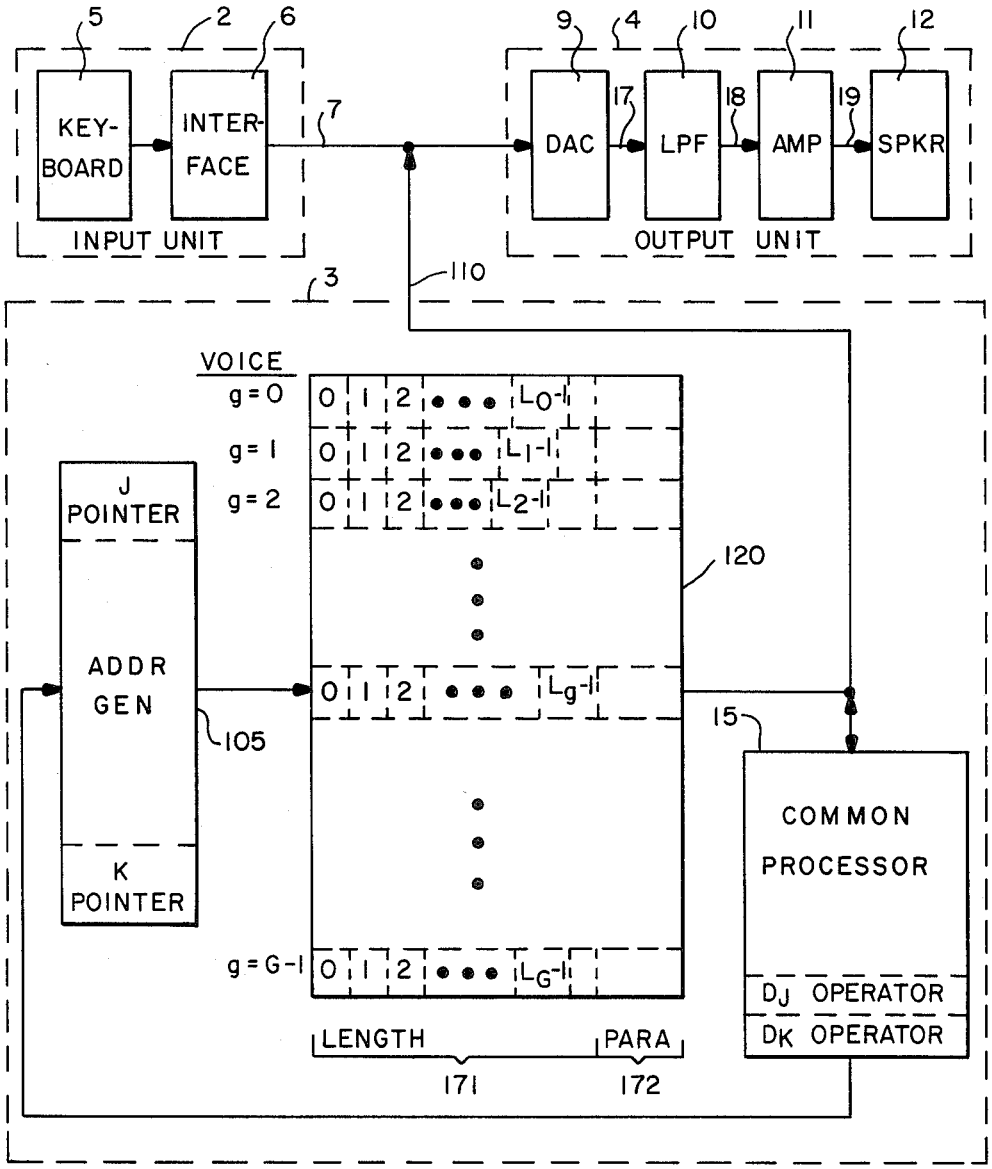
FIG. 2 depicts an expanded electrical block diagram of the FIG. 1 musical instrument.

In FIG. 2, further details of the FIG. 1 instrument are shown. The input unit 2 typically includes a keyboard 5 which connects electrical signals to an interface 6. The musical keyboard 5 is of conventional design and produces electrical signals representing, among other things, notes to be selected, for example, by indicating keys which are depressed. While keyboard 5 may be any standard keyboard device, any other type of input, such as a computer, for specifying notes to be played can be employed. Additionally, the input unit 2 typically includes means for specifying the force (amplitude) of the note and other characteristics such as the duration of the note to be played.

The interface unit 6 encodes the input information (pitch, amplitude, and duration) and transmits it to the wavetable manager unit 3. The wavetable manager unit 3, in response to the input signals from the input unit 2, generates a digital audio output signal on the bus 110 which connects to digital-to-analog converter (DAC) 9 in the output unit 4. The converter 9 converts the digital audio output signal on bus 110 to an analog audio output signal. Analog audio output signals output from the converter 9 connect through a low-pass filter 10 and an amplifier 11 to a speaker 12. The speaker 12 produces the desired musical sound.

In FIG. 2, the wavetable manager unit 3 includes a wavetable unit 120, a common processor unit 15 and an address generator 105. The wavetable unit 120 acts to store digital values which are accessed when addressed by address generator 105 to provide audio output signals to output unit 4. Common processor 15 functions, among other things, to modify digital values stored in wavetable 120.

In FIG. 2, digital values are stored in different locations in wavetable unit 120 and the different locations are accessed under the control of an address provided by address generator 105. In forming an address, two different pointers are used by the address generator 105 to point to locations in the wavetable memory 120. A first pointer, the J pointer, points to the address of digital values which are to be accessed for audio output to the output unit 4. A second pointer, the K pointer, points to the address of locations to be accessed for modification by the common processor 15. The J pointer and the K pointer are independently controllable so that the modification operation and the audio output operation are independently variable and controllable. Both the J pointer and the K pointer are changed, for example, by the common processor 15 under control of a $D_J$ operator and $D_K$ operator, respectively.

In FIG. 2, the wavetable unit 120 is a conventional memory partitioned into G different regions, one for each of the voices, g, where g has the value 0, 1, 2, 3, . . . , G−1. Each voice may have a different number of active locations, $L_g$, which represent the number (length) of digital values stored in the wavetable for that voice. Generally, the digital values from 0 through $L_{G-1}$ are stored in a first region (length) 171 of the memory 120. Associated with each voice is a second region (PARA) 172 for storing parameter values which are associated with that particular voice. Each of the voices, therefore, can have a different number $L_g$, of active digital values and a different set of parameters, $P_g$, stored in the second region 172.

In operation of the FIG. 2 device, the input unit 2 provides input information which specifies the voice or voices to be active and further information and parameters concerning the music to be played. The common processor 15 causes two independent operations to occur. The first operation controls J pointer for selecting particular digital values from the wavetable to be provided as the audio output to the output unit 4. The J pointer changes from one digital value to another digital value under control of the $D_J$ operator.

The second operation controls the selection of locations within the wavetable 120 which are to have the stored values modified. The selection of locations to be modified is specified by the K pointer. The K pointer is changed to specify different locations under the control of the $D_K$ operator. The audio output operation (the J processing) and the modification operation (the K processing) are independent thereby providing great flexibility and control in accordance with the present invention.

Figure 3:
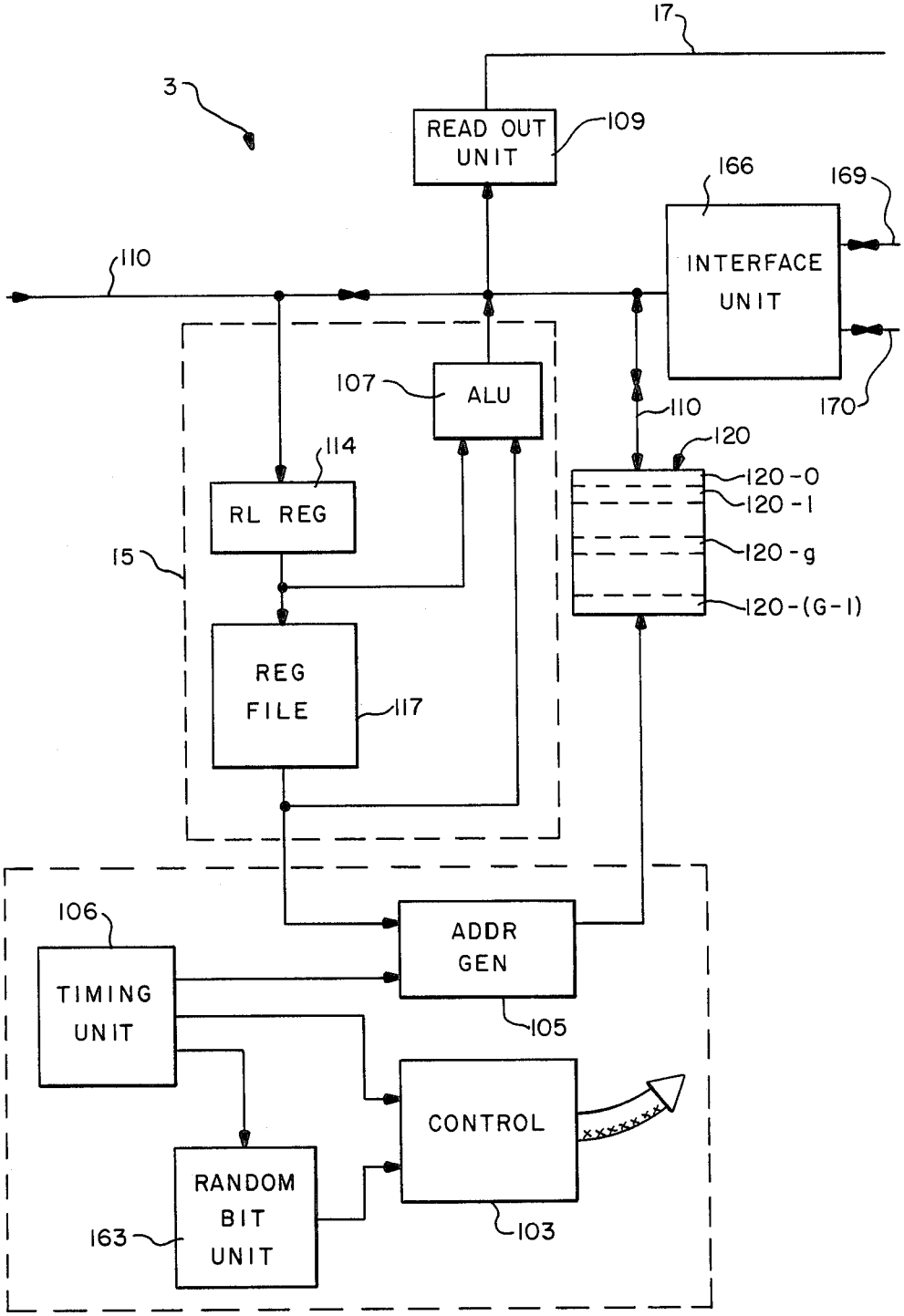
FIG. 3 depicts a schematic electrical block diagram of the modifier unit which forms a portion of the wavetable-modification generator in the FIG. 2 musical instrument.

In FIG. 3, further details of the wavetable manager unit 3 of FIG. 2 are shown. In FIG. 3, the wavetable unit 120 functions to store the wavetable 120-g for each voice. Each voice, g, stores $L_g$ data values and additionally stores associated parameter information. Information is accessed to and from wavetable over the bidirectional data bus 110.

In FIG. 3, the interface unit 166 in one embodiment functions as the input unit 2 of FIG. 2. The interface unit 168 includes registers and other circuits for communicating with a computer. For example, the computer data bus 169 typically connects to the data bus of an Apple computer. Similarly, the computer address bus 170 typically connects to the address bus of an Apple computer.

In FIG. 3, the common processor 15 includes an arithematic and logic unit (ALU) 107, a read latch register (RL REG) 114 and a register file 117. Data from the data bus 110 is stored into the RL register 114, from where it is at times transferred to one of a number of locations $R_0$, $R_1$, $R_2$, and $R_3$ in the register file 117. The arithematic and logic unit 107 performs modifications and posts the modified outputs onto the data bus 110 for storage in the wavetable memory 120 or RL register 114.

In FIG. 3, a timing unit 106 is provided. The timing unit 106 generates clock pulses and other timing signals for controlling the operation of the FIG. 3 circuit. One output from the timing unit 106 connects to a random bit generator 163 which in turn has its output connected to the control 103. Control 103, also receiving inputs from the timing unit 106, sends control signals to virtually all of the circuitry in FIG. 3 for controlling the sequencing in accordance with the present invention. Address generator 105, in response to the timing unit 106 and the J and K pointers from register file 117, control the addressing of the wavetable memory 120 by providing memory addresses on address bus 121.

The readout unit 109 receives audio output data from the data bus 110 to provide an audio output signal over the bus 117. While the various components in unit 3 of FIGS. 2 and 3 have been related by common reference numerals, the various components of FIG. 3 typically share some common functions in accordance with the present invention.

Wavetable Unit

The wavetable unit 120, in the absence of any modification in common processor 15 will generate an audio input signal, $y_t$, which can be periodic with a delay time, p, where p is typically equal to $L_g$, the length of the wavetable for the voice g. When the original contents in the wavetable are $x_t$, the audio output signal, $y_t$, can be expressed as follows:

$$y_t = y_{(t-p)} = x_t$$

If time, t, is quantized to discrete values, n, and p equals N values of n, where N is an integer, and $x_n$ represents N discrete values of $x_t$, then the wavetable musical output can be written as follows:

$$y_n = y_{(n-N)} = x_n.$$

If the operation in accordance with the above equation is followed, tne initial contents of the wavetable are output repeatedly cyclically with N to produce an unchanging, periodic waveform which, without modification, is not musically satisfactory. The pitch (frequency) of the sound is determined by the value of N. Such operation, as described in the above-identified cross-referenced application, is unsatisfactory. Because a modification is usually made to the contents of the wavetable, the above equation usually does not apply to the audio output signal utilized in the above-identified cross-referenced application or in the present invention.

For purposes of this specification, a "wavetable" is defined to be a memory which stores a plurality of sample values (for example, N values) where those values are accessed sequentially to produce an audio output with a pitch determined by the periodic frequency with which those values are accessed for output. In a simple wavetable of length N with periodic output determined by N, the pitch frequency is $f_N$. The values in the wavetable may or may not be modified in accordance with the present invention.

Overview

In the present invention, $y_t$ is defined as the audio output signal from a wavetable for one voice at sample time t. The audio output is represented by a sequence of digital values sent to a digital-to-analog converter (DAC) and consists of $y_0, y_1, y_2, \ldots, y_t, \ldots$ and so on. Each digital output $y_t$ is converted to an analog signal which generates the musical sound. In a digital system, the sampling frequency, $f_s$, is the frequency at which one of the values from a wavetable is selected and provided as a value $y_t$ to the output unit to form the musical sound.

In the present invention, a number G of different voices may simultaneously exist. Each voice, g, where g ranges from 0 to G−1, can present a different value of $y_t$ as an output each sample time t. Therefore, the sample time t is divided into G different segments, one segment for each voice g. Accordingly, the output is appropriately designated $y_{t,g}$. For example, the fifth sample (t=5) for the third voice (g=3) is $y_{5,3}$. The sampling period for each voice, that is for example, the time between the fifth sample of voice three, $y_{5,3}$, and the sixth sample of voice three, $y_{6,3}$, is typically the same and is equal to $1/f_s$. Since the processing for each voice is typically the same, the following description frequently omits the voice subscripts, "g", it being understood that they are implied.

The digital values of $y_{t,g}$ selected for audio output for a voice g are obtained from a wavetable having at least $L_g$ active locations although more memory locations may be allocated in a specific design. Each wavetable location stores digital values as data words. The quantity $w_i$ is the value of the $i^{th}$ word for the $g^{th}$ voice in the wavetable where "i" ranges from 0 to $L_g-1$. Each sample time t, some value $w_{i,g}$ is selected as the output $y_{t,g}$. These selected values of $w_{i,g}$ are a function of time, t, but the subscripts, t and g are usually eliminated from $w_{i,g,t}$ for clarity and $w_i$ is understood to be evaluated at time t for voice g. The number of words in the wavetable may be different for each voice.

A wavetable $W_g$ is present for each voice and therefore $W_g$ designates the wavetable for the $g^{th}$ voice where g ranges from 0 to G−1. Each wavetable may have a different active length $L_g$ for storing the data words $w_{i,g}$ where i ranges from 0 to $L_g-1$. As indicated, the subscripts g are usually dropped and are implied. L can be varied from note to note for any voice up to a maximum value equal to the total number of words of memory allocated to the wavetable for that voice. For a particular note and voice, $L_g$ will generally be constant and only a portion of the total available memory for that voice will be actively used.

The values of $w_i$ in the wavetable for each voice are sequentially modified, usually at irregular intervals at a modification frequency, $f_m$, where $f_m$ in general is not a constant with respect to time so that the musical sound changes as a function of the modification. Also the values of $w_i$ in the wavetable are accessed for audio output at different rates so that the musical sound (pitch) also changes as a function of the rate of accessing for audio output. Note that the accessing rate, $f_j$, for audio output may be different from the sampling rate, $f_s$. Also, the accessing rate, $f_m$, for modification may also be different from the sampling rate, $f_s$.

Two different and relatively independent operations are employed in determining the particular ones of the $w_i$ values accessed from a wavetable for modification and for audio output.

A first operation (audio output operation) employs the $J_{t,g}$ pointer. For each sampling time t, the pointer $J_{t,g}$ points to one of the $L_g$ different values of $w_i$ which is to be selected as the output $Y_{t,g}$. The value of pointer $J_t$ changes (or may change) with time, for example, once each time "t". The amount of change, each time t, is controlled by an operator $(D_J^*)_{t,g}$. The voice subscript g is usually dropped for clarity.

Although the pointer $J_t$ points to one of the L locations, where L is an integer 0 through L−1, the pointer $J_t$ may be fractional including both an integer, $j_t$, and a fraction, $J_j-j_t$, where the included integer modulous L, from 0 to L−1, specifies the actual location of $w_i$ where "i" is some integer value 0 through L−1. Accordingly, the change of $J_t$ is controlled by the operator $D_J^*$ and such changes may or may not be integer values. The frequency of change of $J_t$ is $f_J$ and the frequency of change of $j_t$ if $f_j$ where $f_J$ and $f_j$ are in general not equal nor constant with respect to time.

A second operation (modification operation) employs the $K_{t,g}$ pointer. For each sampling time t, the pointer $K_{t,g}$ points to one of the $L_g$ different values of $w_i$ which is to be selected as the output $m_{t,g}$. The value of pointer $K_t$ changes (or may change) with time, for example, once each time "t". The amount of change, each time t, is controlled by an operator $(D_K^*)_{t,g}$. The subscript g is usually dropped for clarity.

Although the pointer $K_t$ points to one of the L locations, where L is an integer 0 through L−1, the pointer $K_t$ may be fractional including both an integer, $k_t$, and a fraction, $K_t-k_t$, where the included integer modulous L, from 0 to L−1, specifies the actual location of $w_i$ where "i" is some integer value 0 through L−1. Accordingly, the change of $K_t$ is controlled by the operator $D_K^*$ and such changes may or may not be integer values. The frequency of change of $K_t$ is is $f_K$ and the frequency of change of $k_t$ is $f_k$ where $f_K$ and $f_k$ are in general not equal nor constant with respect to time.

For convenience in the embodiment of the invention described, the frequencies, $f_J$ and $f_K$, with which the operators $(D_J)_t$ and $(D_K)_t$, respectively, are applied to change the pointers $J_t$ and $K_t$ are equal to the sampling frequency, $f_s$. This equality condition is not a requirement in that $f_J$, $f_K$ and $f_s$ may all be different and relatively independent of each other. Even when $f_J$ and $f_K$ are equal, however, $f_j$ and $f_k$ are generally not equal and are decoupled.

The pointer $J_t$ is a real-valued pitch audio-phase pointer (at sample time t) that consists of an integer part $j_t$ and a fractional part $J_t-j_t$. The pointer $K_t$ is a real-valued modification phase pointer that consists of an integer part $k_t$ and a fractional part $K_t-k_t$. Hereinafter, the time subscript, t, is often omitted from J, K, j, k, $D_J$ or $D_K$ but it is understood to be implied. The integer parts j and k are constrained to be integers from 0 through L−1, inclusive. Also, in practical embodiments, J and K are maintained to a finite-number-of-bits precision, that is, have a fixed number of fraction bits. In one particular embodiment, J=j and K=k, that is, there are no fractional parts, just integers.

The update operator $D_X^*$ is defined, where X can be J or K and is a function of time and voice, and can be written $(D_X^*)_{t,g}$. The symbol "$D_x^*$" is a notation used to denote an operation which may have many different embodiments whereas "$D_X$" without an "*" denotes one particular operator which functions to perform "$D_X^*$". Again, the t and g subscripts are usually omitted and implied.

In one embodiment, $D_X^*$ consists of a random component called "jitter", which is a randomly generated (for each sample) number $(u_x)_t$, uniformly distributed in the range 0 to $R_X$ (where $R_X$ is some number with absolute value less than or equal to one), and a non-random component $(v_X)_t$, which is generally a fraction between 1 and 0 or 0 and −1. Thus, in such an embodiment, $D_X=u_X+v_X$ and the operation of $D_X^*$ upon X can be described by the following Eq. (1):

$$X_t=D_X^*(X_{t-1})=X_{t-1}+(u_X)_{t-1}+(v_X)_{t-1} \quad \text{Eq. (1)}$$

The result of the addition represented by the right-hand side in Eq. (1) is truncated to its finite precision and the integer part is adjusted modulo L, that is, adjusted into the range 0 to L−1.

At each sample time t during a J operation (audio output operation), Eq. (1) is applied so that $D_J$ acts upon $J_{t-1}$ to produce a new $J_t$. The application of Eq. (1) to form $J_t$ is given by Eq. (2) as follows:

$$J_t = J_{t-1} + (u_J)_{t-1} + (v_J)_{t-1} \quad \text{Eq. (2)}$$

The new integer part, $j_t$, of $J_t$ after the addition of the right-hand side of Eq. (2) is used to point to a stored data value, $w_i$, in the wavetable to output to the digital-to-analog converter.

At each sample time t durng a K operation (modification operation), Eq. (1) is applied so that $D_K$ acts upon $K_{t-1}$ to produce a new $K_t$. The application of Eq. (1) to form $K_t$ is given by the following Eq. (3):

$$K_t = K_{t-1} + (u_K)_{t-1} + (v_K)_{t-1} \quad \text{Eq. (3)}$$

The new integer part, $k_t$ of $K_t$ after the addition of the right-hand side of Eq. (3) is used to point to a stored data value, $w_i$, in the wavetable which is to receive the modified value. If the new integer part, $k_t$, is different from the old integer part, $k_{t-1}$, then a modification is made in the wavetable.

If $D_K$ tends to increase K, then the modification made to form the modified data value, $w_i$, is in accordance with the following Eq. (4):

$$w_i = (1-1/M)w_{i-1} + (1/M)w_{i+M-1} \quad \text{Eq. (4)}$$

If $D_K$ tends to decrease K, then the modification made to form the modified data value, $w_i$, is in accordance with the following Eq. (5):

$$w_i = (1-1/M)w_{i+1} + (1/M)w_{i+1-M} \quad \text{Eq. (5)}$$

In Eq. (4) and Eq. (5), "M" is a modification control valve. Note that for M=1, both Eq. (4) and Eq. (5) reduce to $w_i = w_i$ and no effective modification occurs. For M=2, both Eqs. (4) and (5) become $w_i = \frac{1}{2}(w_{i-1} + w_{i+1})$ so that the value in the wavetable is replaced by the average of its two immediate neighbors irrespective of whether $D_K$ tends to increase or to decrease K.

The modification control parameter M provides a powerful but coarse control over the decay rate of the note, while $D_K$ provides more precise control over a more limited range of decay rates. When used together, M and $D_K$ provide effective control of decay times.

For an embodiment where $K_t$ equals $K_{t-1} + D_K$ and $D_K$ cannot cause k to change by more than 1 each time, the decay rate of the output signal is proportional roughly to $M(M-1)D_K/L^3$. Therefore, the wavetable length, L, has a strong effect on decay rates. In many embodiments, L is kept constant at the maximum wavetable length. In other embodiments where L is varied from note to note, the decay-rate variation with L is perfectly natural since, in a real plucked string, shorter active lengths produce faster decays.

Large values of M are especially useful in those embodiments where limited compute time or compute power is available for each modification computation (for example, where a large number of voices, slow components, or a software implementation are used), since a large M-value will cause a large amount of decay. In many practical implementations, M will be restricted to a power of two, so that the divisions and multiplications indicated in Eqs. (4) and (5) are implemented by shifting a number of bits. For powers of 2, Eqs. (4) and (5) are rewritten as Eqs. (6) and (7), respectively, as follows:

$$w_i = w_{i-1} - (w_{i-1} - w_{i+2m-1})/2^m \quad \text{Eq. (6)}$$

$$w_i = w_{i+1} - (w_{i+1} - w_{i+1-2m})/2^m \quad \text{Eq. (7)}$$

where:

m = positive integer greater than 0

$2^m = M$.

In Eqs. (6) and (7), M equals $2^m$ and the trivial case M=1 is eliminated. The division by $2^m$ indicated above is actually done by a right shift of m bits; thus the only hardware necessary for the computation is an adder/subtractor (which is also needed for other computations) and a shifter. No complicated multiply/divide hardware is required since the modulo L subscript reduction can be accomplished by conditionally adding or subtracting L.

Further simplification is possible for M=2 (m=1). In a typical digital implementation, the $w_i$ values are stored in words of finite size, usally from eight to sixteen bits long. Consequently, the right shift of m bits causes the low-order m bits of the result to be "lost" since there is no convenient place to store them. If the word size is large enough (for example, 16 bits), this loss is not serious. For smaller word sizes (for example, 8 to 12 bits), the loss can cause problems when the signal amplitudes are small. The problem is that the ends of notes appear to be suddenly squelched rather than dying smoothly away to silence. In the latter case, it is better to round the shifted result up or down, based on the value of the lost bits and possibly some random bits as well. This random rounding, called "dither", tends to counteract the effect of small word sizes.

One preferred embodiment of the invention allows substantial control of dithering. Specifically, in one embodiment, selection is made from among sixteen different probabilities for rounding-off instead of truncating. Probability 0 leads to the squelching effect mentioned above. With probability $\frac{1}{2}$, the note never decays to silence, but instead ends up with a persistent (although quiet) hissing noise. Better results are obtained in the embodiment described with dither probabilities close to, but not equal to, $\frac{1}{2}$.

To keep the DAC sampling frequency constant at $f_s$, the action of $D_J$ on J preferably occurs at regularly spaced intervals of $1/f_s$ (for a given voice). For convenience in the above discussion, the action $D_K$ on K with a frequency $f_m$ was chosen and assumed to occur at the same frequency as $D_j$ on J. This choice of the same frequency is practical for hardware implementations. However, in certain embodiments (for example, when the wavetable modification is done by a program running on a general-purpose processor, and the readout to the DAC is done by hardware using direct memory accessing, DMA) it is more convenient (and sometimes necessary) to have the modification frequency $f_m$ (frequency that $D_K$ acts on K) different from the DAC sampling frequency $f_s$ (frequency that $D_J$ acts on J). In such cases, the two frequencies $f_m$ and $f_s$ can be completely asynchronous with respect to each other.

The actual decay rate of a note is dependent on $f_m$ (as well as on $D_K$, M, and L), but not on $f_s$ or $D_J$. The pitch (fundamental frequency), on the other hand, depends on $f_s$, $D_J$, and L, but not on $f_m$, $D_K$, or M. Hence, the decay is decoupled (that is, separated) from the control (pitch), allowing precise, independent control of each. This decoupling is a highly desirable independent tuning feature which was not present in the embodiment described in the above-identified cross-referenced application where changes in decay had a significant effect on the pitch. In that application, the control was crude and too coarse to be fully useful. The decoupling of the present invention is not dependent on $f_s$ and $f_m$ being different. In the embodiment described, although $f_s=f_m$ decoupling stems from the use of different pointers (J and K) and update operators ($D_J$ and $D_K$) for the audio output and the wavetable modification operations.

This independence of decay rate (K modification operation) and pitch (J audio output operation) is possible only if the wavetable modification changes only the magnitudes and not the phase angles of the frequency components present in the wavetable, that is, the arguments of the complex Fourier coefficients are preserved. This condition is assured to a sufficient degree by choosing the subscripts to depend on M in the way indicated by the modification equations, Eqs. (4), (5), (6) and (7) above.

In actuality, there is a very slight phase shift inherent in the modification, which causes a very slight pitch dependence on $D_K$, M, and $f_m$. The relative change in fundamental frequency is approximately proportional to $(M-\frac{1}{2})3f_mD_K/L^3$. For reasonable values of the parameters, the resulting pitch change is too small to be audible. For $M=2$, $L=128$, $f_m=f_s$, the difference in frequency between $D_K=0$ and $D_K=1$ amounts to less than 1 part in 50,000. The strong dependence on M and L, however, dictates against the simultaneous use of large M and small L values. In one preferred embodiment, M is fixed at 2, and L is constrained to be less than 254. As long as L is greater than about 32, the pitch shift between the extreme values of $D_K=0$ and $D_K-1$ amounts to a relative frequency shift of less than 1 part in 1000. Such a shift is imperceptible for a single tone and is masked by the pitch phase jitter described below.

Ignoring the very small effect described, the fundamental frequency $f_0$ is approximated, in the embodiment described where $J_t=J_{t-1}+D_J$, by the relation $f_0=f_sD_J/L$. The highest audible frequency (cut-off frequency, $f_c$) is given by the sampling theorem $f_c=f_sD_J/2$. Combining these last two expressions yields the following Eq. (8):

$$f_c=(L/2)f_0 \qquad \text{Eq. (8)}$$

In Eq. (8), the tone contains (L/2) harmonics, whose amplitudes are given by the magnitudes of the complex coefficients of the discrete Fourier transform of the length-L active wavetable at the time in question. The higher harmonics delay faster than the lower ones. The initial amplitudes of the various harmonics are determined by the initial table load.

By appropriately choosing values for the two parameters $D_J$ and L, both the pitch and the cut-off frequency are independently controlled within certain limits so that there is a further degree of decoupling. Also if the condition exists that $D_J$ cannot cause j to change by more than 1 each time, the cut-off frequency will be such that no aliasing (foldover of frequency components greater than half the sampling rate) can occur. This condition is automatically insured in the described embodiment, where the absolute value of $R_J+V_J$ is less than or equal to 1. This condition is highly desirable from an acoustical standpoint.

The decay rate, DR, is approximately by the following Eq. (9):

$$DR=f_mM(M-1)D_K/L^3 \qquad \text{Eq. (9)}$$

Assuming that $f_m=f_s$ and that L is determined by the desired pitch and cut-off frequency as outlined above, the parameters M and $D_K$ in Eq. (9) can be adjusted to achieve the desired decay rate, again within certain practical limits. In the embodiment described, where M is fixed at 2, $D_K$ alone is available for this control, assuming again that L has been already determined.

The present invention permits extensive control over various acoustical properties of the tones produced. In a multi-voice embodiment, in general $D_J$, $D_K$, L and possibly M will be different for each voice, whereas the sampling and modification rates $f_s$ and $f_m$ are typically the same for all voices and all notes. This condition allows most of the relevant hardware (adder, RAM, DAC, and so forth) to be shared among all voices on a round-robin, time-interleaved basis. This sharing of hardware significantly reduces the cost compared with other multi-voice implementations which vary the pitch by varying the sampling rate and which duplicate many components. In such multi-voice implementations where sampling rate determines pitch, two musical pitches on two different voices may happen to have their frequencies in the ratio of two small integers. For example, for an octave, the ratio would be 2 to 1; for a musical fifth, 3 to 2; for a musical forth, 4 to 3. If this ratio upon quantization turns out to be exact, the undesirable phenomenon of phase-locking occurs. When phase-locking occurs, the harmonics of one note are indistinguishable from (that is, coincide with) some of the harmonics of the other, and the result is perceived as a single note whose frequency is equal to the greatest common divisor of the two original frequencies.

This undesirable effect of phase-locking can be countered in the present invention by using a sufficient amount of pitch phase jitter. In one preferred embodiment, the J pointer (audio output) is maintained to a precision of twelve bits, consisting of eight integer bits (which hold the value of j) and four fraction bits (which hold J-j). $D_J$ is maintained as a 9-bit binary fraction between 0 and 1. Thus $D_J$ has five more fraction bits than J. When J and $D_J$ are added, five random (probability $\frac{1}{2}$) bits are appended to the low-order part of J and are thus combined with the low-order five bits of $D_J$. The result is then truncated to only 4 fraction bits (plus the usual eight integer bits) before being stored as the new J. This operation has the effect of causing small irregularities in the phase and these irregularities are enough to destroy any phase-locking which might otherwise occur.

At the same time that phase-locking is avoided, adequate pitch precision is still assured. The small phase irregularities (pitch phase jitter) introduced into the J operation of the present invention are similar to those which occur in real physical string instruments. In the embodiment described, the pitch phase jitter can be obtained by setting $R_J-1/16$ in determining the value of $u_X$. Strictly speaking, the 9-bit binary fraction value of $D_X$ between 0 and 1 should be referred to as $v_J$ but for convenience it is loosely referred to as $D_J$ when the random component (jitter) is not an issue.

In the current embodiment, it is possible to control to a certain extent how much of the total excitation energy is to be concentrated in the lower frequencies at the expense of the higher frequencies.

Noise in which more energy is concentrated in the lower frequencies is sometimes referred to as "pink noise". The current invention allows control of the "pinkness" of the initial noise burst. This control is accomplished by initializing the wavetable values, $w_i$, in accordance with the following Eq. (10):

$$w_i = A(R_{zi}^*)(B_{zi}^*) \quad \text{Eq. (10)}$$

where:

A = amplitude $R_{zi}^* = +1$ or $-1$ as a function of random number operator, R*

$B_{zi}^* = +1$ or $-1$ as a function of a control operator, B*

$i = 0, 1, \ldots, (L-1)$

The random number operator, R*, is determined by the output from a random number generator. The control operator, B*, may be determined using any technique such as a table look-up or input command. In the embodiment described, the value of L is used as follows to determine B*.

The value of L for any voice is expressed in binary form by the binary ("1" or "0") bits n0, n1, . . . , n7 so that L is given by the following Eq. (11):

$$L = 2^{n0} + 2^{n1} +, \ldots, 2^{n7} \quad \text{Eq. (11)}$$

The control operator B* selects the value of +1 or −1 as a function of the value of the logical 1 or logical 0 value of one of the bits n0 through n7. For L greater than 192, look at bit n7; for L between 96 and 192, look at bit n6; for L between 48 and 96, look at bit n5; for L between 24 and 48, look at bit n4 and so on (lsb = bit n0). As a function of one of the bits n0 through n7, $B_{zi}^*$ determined in this fashion produces a squarish wave with a duty cycle between 33% and 67% depending on L. For example, for L = 128, the duty cycle is 50%.

As mentioned earlier, the probability of $R_{zi}^*$ being +1 as opposed to −1 can be specified and is called a probability p. If $p = \frac{1}{2}$, the result is white noise of amplitude A. In this special case, $B_{zi}^*$ does not really matter, since +A is as likely to be chosen as −A. If p = 0, a deterministic squarish wave (namely, $-AB_n$) results, having the most energy concentrated in the lower harmonics. For such a wave, the $q^{th}$ harmonic has amplitude bounded by 1/q. For intermediate values of p, for example, $p = \frac{1}{4}$, the result is pink noise, where the shade of pink is specified by p. This control of pinkness is important in simulating the "pick position" where the string is plucked. A string plucked near one end will have a lot of energy in the high harmonics (white noise excitation) whereas a string plucked in the middle will have roughly the same frequency spectrum as a square wave.

In guitar terminology, the difference is between the "metallico" timbre produced by plucking very close to the bridge, and the "dolce" timbre obtained by plucking closer to the fingerboard. In the embodiment described, there are sixteen available choices for the probability p, ranging between 0 and $\frac{1}{2}$, thus allowing a wide range and subtle gradation of this important timbral characteristic. This control can also be combined with the "cut-off" frequency described earlier to further alter the timbre. This control is relatively simple and merely requires looking at the value of a certain bit to decide whether to negate (complement) the amplitude or not.

A further option with the current invention is to probabilistically negate or clear the value $y_t$ before it is sent to the DAC. Because of the nature of the recurrence used in the current invention, negating before storing does not generally produce useful results, and thus negation after storing but before sending to the DAC is useful to obtain a drum sound. A further option is to clear instead of negating. This clearing produces a novel drum sound with a definite pitch.

Sixteen Voice Embodiment

One embodiment of the current invention, shown in FIGS. 4 through 7, utilizes standard TTL and MOS components clocked at a rate of 7.16 MHz or less and produces up to sixteen independent voices. Samples for each voice are in wavetables stored in memory 120 in FIG. 5 to a precision of 12 bits. Pitches can be specified to an accuracy of better than four cents over an approximately seven octave range where one cent equals 1/1200 of an octave. Sixteen different decay rates are available which can be specified for each note without audible alteration of the note's pitch. Eight choices are available for the amplitude of the initial excitation (pluck).

The distribution of energy among the different harmonics in the frequency spectrum of the initial excitation is controlled with sixteen different choices. Sixteen different values for a dither probability can be specified; however, because of the symmetry about the value $\frac{1}{2}$ the number of effectively distinguishable choices is approximately eight since values like 7/16 and 9/16 are not effectively distinct. A "pairing" of dither values is exploited in order to determine when "drum mode" is selected.

The "cut-off" frequency, the uppermost nonzero frequency component of the waveform, can be specified independently for each voice up to a maximum of one-half the sampling frequency for that voice. At the maximum clocking rate of 7.16 MHz, the normal sampling rate for each voice is approximately 28 KHz, leading to a maximum specifiable cut-off frequency of 14 KHz. However, since human hearing can extend up to about 20 KHz, provision is made for doubling the normal sampling rate (and hence the maximum cut-off frequency as well) for certain voices if desired. This doubling is done by coalescing certain pairs of voices into single, double-rate voices. If this coalescing option is chosen, the number of voices is reduced from 16 normal-rate voices down to a total of 12 voices (consisting of 8 normal and 4 double-rate voices). The double-rate voices are useful in simulating the highest, thinnest strings of a conventional plucked-string instrument, for example, guitar.

The embodiment described readily simulates two 6-string guitars. If 12 or 16 voices are too many and 6 or 8 would suffice (for example, to simulate a single guitar), the described embodiment is configured with half as much memory and clocked at a slower rate (for example, 3.58 MHz), thereby reducing cost (fewer and slower memory chips). This reduction process can be repeated to yield four or even fewer voices. Conversely, when faster, larger memories are selected, the invention can easily be expanded to handle 24, 32, 48, 64, and so on, voices. Fundamentally, the amount of addressable memory determines the number of voices although the clocking rate must also be adjusted to select workable sampling rates. This flexibility in the number of voices is a significant advantage of the present invention.

Flexibility is achieved by storing all the parameters for a particular voice (including pitch, decay rate, phase pointers, and so on) in the same memory buffer 120 as the wavetable itself is stored. Each voice, in one example, is allocated a 256-word buffer in memory, but the wavetable itself is restricted to be at most 248 words long in the length region 171, leaving eight words free for storing the parameters associated with that voice in the parameter region 172.

Each voice has its own associated wavetable comprised of the regions 171 and 172. In order to produce one sample for a particular voice, a total of 16 clock cycles are used (comprising one "logic cycle"). During a logic cycle and for one voice, all necessary parameters are retrieved, updated, and rewritten to/from that voice's wavetable regions 171 and 172. When the next logic cycle is started (usually for a different voice), the logic cycle is started with a "clean slate" for that different voice, that is, all the necessary parameters are again fetched from memory.

Figures 4, 5, 6, 7:
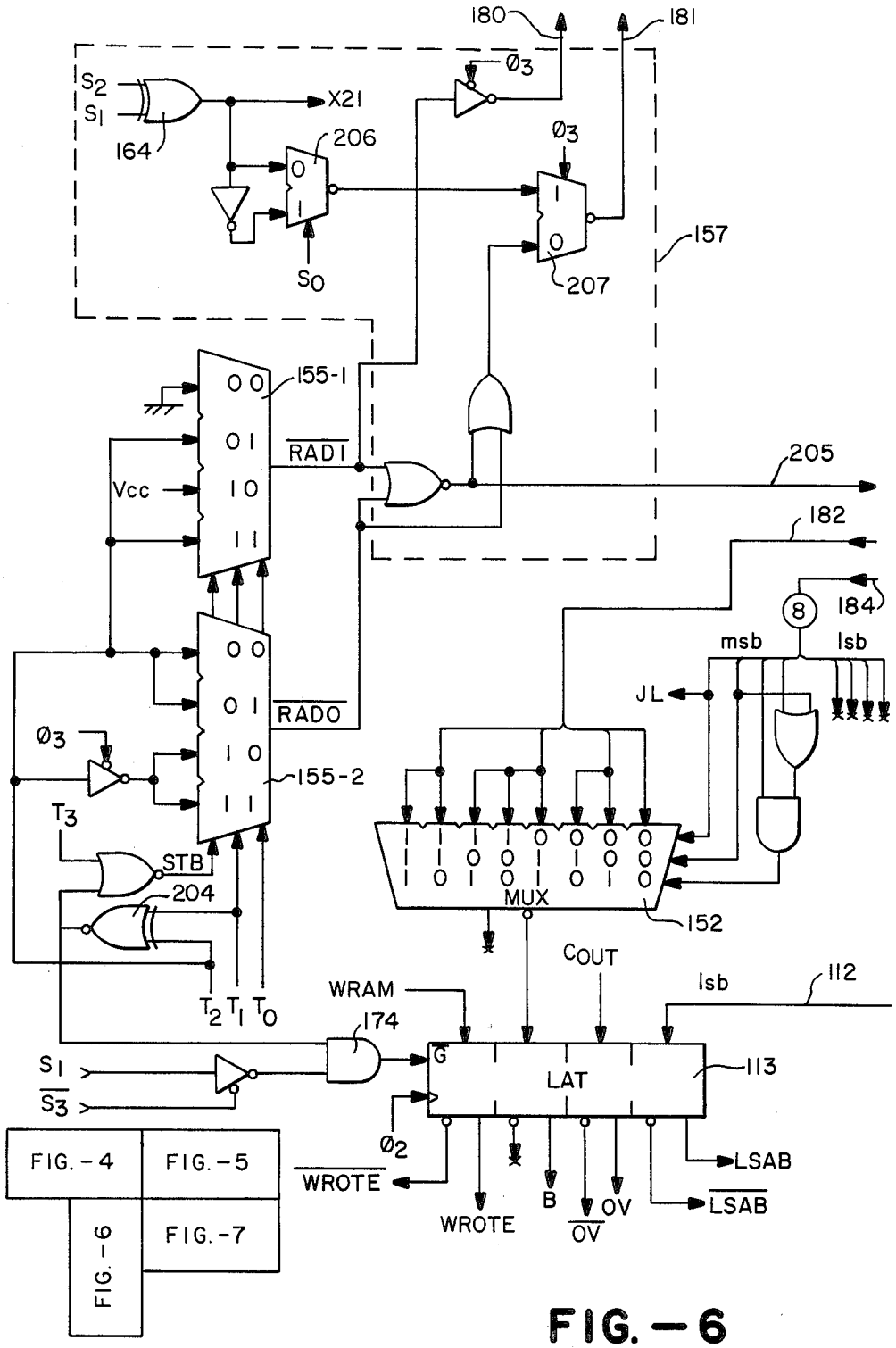
Figure 5:
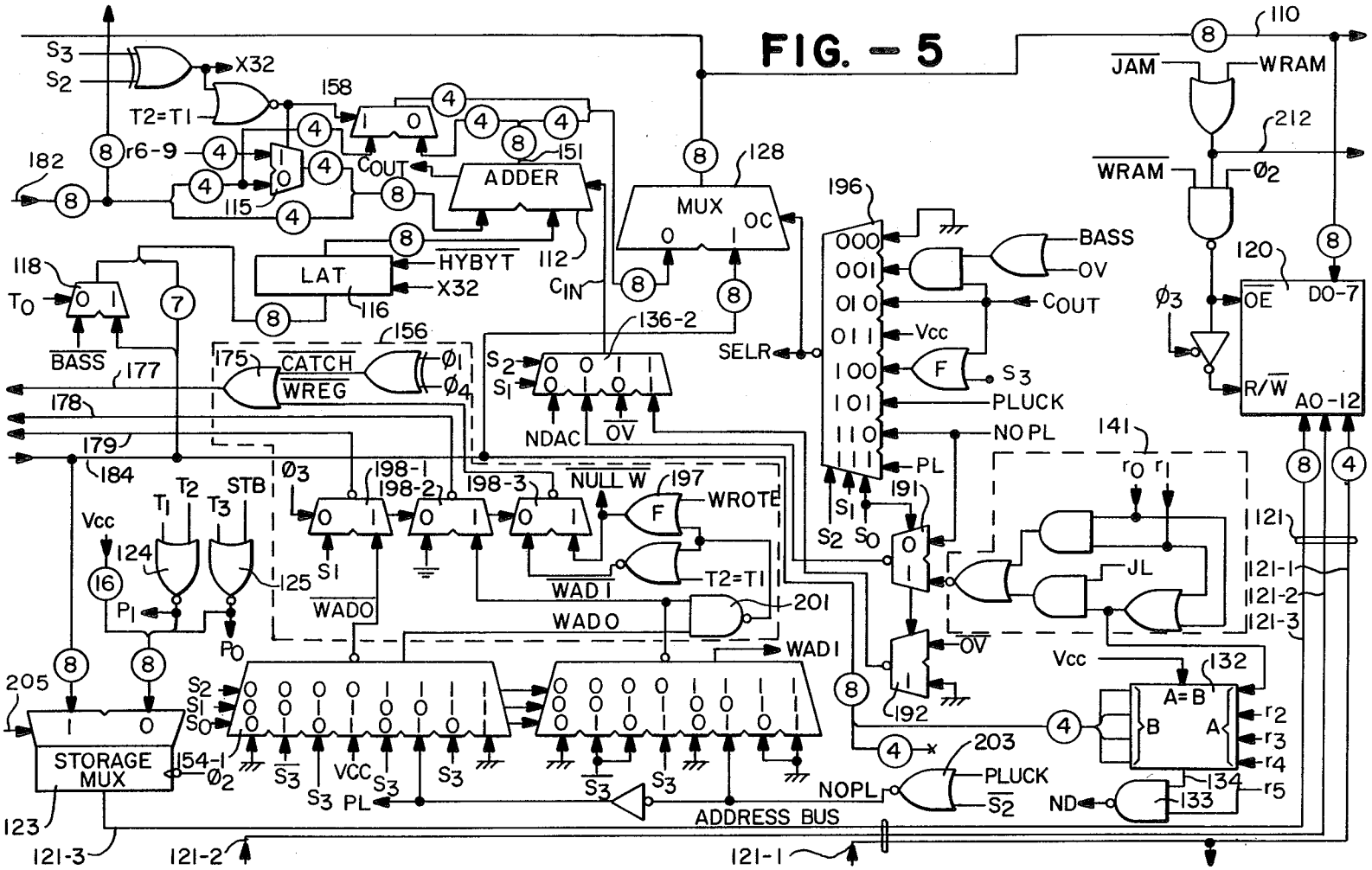
Figure 7:
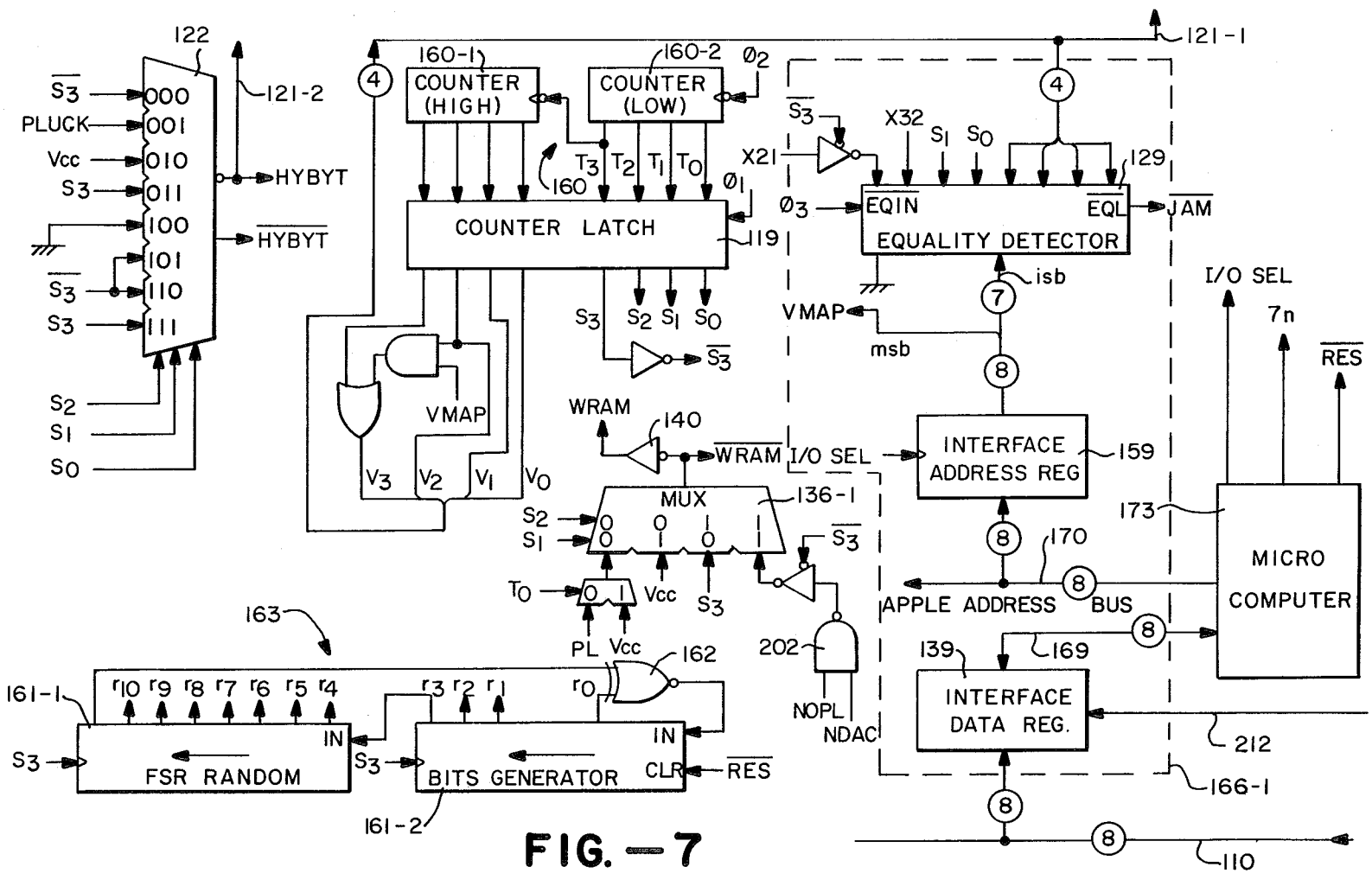

An 8-bit counter 160 (74LS393) in FIG. 7 is used in one embodiment to control both the logic-cycle timing and the voice addressing. The four low-order bits from stage 160-2 of the counter 160 define which of the sixteen clock cycles that makes up a logic cycle is the current one, while the four high-order bits from stage 160-1 of the counter 160 define which of the sixteen voices is current. These four "voice bits" from stage 160-1 form the high-order four bits of all addresses sent to the memory 120 of FIG. 5 during the current logic cycle thereby forcing all such memory accesses to be to/from the memory buffer associated with the current voice.

If, for example, only eight total voices are desired, then the highest-order of these four voice bits are ignored by the (half-as-big) memory 120, thereby coalescing voices 0 and 8, 1 and 9, and so on into double-rate voices (usually the clocking rate is halved to bring these double rates back down to "normal"). If a mix of normal and double-rate voices is desired, then the highest-order address bit could be forced to be a 1 if the next-highest-order bit is also a 1. If four address bits are sent to memory to determine the voice number, then this would produce eight normal and four double-rate voices. In the preferred embodiment, this voice bit remapping is specified by a control bit, according to whether such voice coalescing is desired or not. In order to expand beyond sixteen words, the 8-bit counter 160 of FIG. 7 is enlarged to 9, 10, or more bits. Each such extra counter bit doubles the number of voices, but of course the memory size also needs to be increased and clocked faster as well.

In the above-identified cross-referenced application, the parameters associated with a particular voice were not stored in the same external memory containing the wavetables. Instead, these parameters were stored in an on-chip shift register of fixed length (16 stages). The voice bits were the low-order bits of the memory address, and a common write-pointer address was used for all the voices (for both modification and audio output to the DAC). In that embodiment, there was an inflexible 16-voice restriction. In the present invention, since the modification pointer (K) and audio output pointer (J) are in general different even for the same voice, such common pointers are no longer used, and separate pointers are employed for (and stored with) each voice thereby providing flexibility.

Logical Cycle

Each logic cycle consists of 16 clock cycles. Each clock cyle is subdivided into two equal phases, namely phase 1 and phase 2. The clock cycles are numbered consecutively from 0 through 15 with a subscript 1 or 2 used if necessary to distinguish the phase. For example, the notation $5_2$ refers to clock cycle 5, phase 2. In general, during phase 1 an address is sent to memory 120 (at the beginning of phase 1), and during phase 2 data is retrieved from (or sent to) that address (at the end of the phase). Each clock cycle corresponds to a memory cycle, and therefore there are 16 memory cycles per logic cycle.

Cycle Count

The counting through the sixteen cycles in a logic cycle and the cycling through all the voices is done by a 84LS393 circuit which forms counter 160 of FIG. 7, whose outputs are latched at the beginning of each clock cycle by $0_1$ (start of phase 1) by a 84LS273 circuit forming latch 119. The four low-order bits of counter latch 119 are named $S_3$, $S_2$, $S_1$, and $S_0$ and their binary value defines the number of the current cycle. For example, for cycle 5 they equal the binary code 0101. The four high-order bits are used to determine the four voice-identification bits $V_3$, $V_2$, $V_1$, and $V_0$ (after possibly being remapped if voice coalescing is specified) which form the high-order part on lines 121-2 of all addresses sent to memory 120. The reason that outputs from the counter latch 119 are used rather than from the counter directly is that the 74LS393 circuit of counter 160 is a rather slow ripple-carry counter and a considerable amount of time is needed for the carry to propagate to the high-order bits. The propagation delay would detract from the memory access time if these bits were directly used as address bits. By latching the counter outputs and then immediately instructing the counter to increment its contents, the full duration of the clock cycle is available both for the memory access and for the counter incrementation. An additional advantage of this latching scheme is that the four low-order bits from the counter can be used for "look-ahead" since during the latter part of a cycle they contain the number of the next cycle. These four low-order bits are called the T bits $T_3$, $T_2$, $T_1$, and $T_0$ and represent a binary number which is often greater than that contained in the corresponding S bits (for most of the cycle). These T bits are used in various places in the circuit where look-ahead is necessary or convenient. The higher-order $T_{4,5,6,7}$ bits from stage 160-1 take longer to stabilize and are not used for this purpose.

Memory

The data bus 110 in FIG. 5, connecting to memory 120, is 8 bits wide, facilitating the use of easily available memory chips which are organized as $nK \times 8$ bits. For 16 voices, typically a single HM6264 memory chip is used, which is organized as $8K \times 8$ and comes in a 28-pin package. For a clocking rate of 7.16 MHz, a 120-nanosecond access-time version is satisfactory.

Since the wavetable samples are maintained to a precision of 12 bits, it takes two memory cycles of memory 120 to read or write such a sample. The four extra bits are used for various purposes such as dither and drum-mode control. Briefly, the first eight clock cycles in a given logic cycle are used for updating the audio output pointer J and reading out the appropriate sample to the digital-to-analog converter (DAC) 111, whereas the last eight clock cycles update the modification pointer K and perform the wavetable modification if necessary.

Besides the afore-mentioned memory access cycle, each clock cycle also allows for an addition in adder 112 of FIG. 5 of two 8-bit quantities with a selectable carry-in, Cin. In certain cycles, random bits are substituted for the four low-order bits of one of the adder inputs in order to effect the probabilistic dither and the phase jitter necessary to prevent phase-locking between voices. The four "lost" bits in these cycles are re-injected into their respective positions in the data path after the adder 112 (the four random bits serve merely to generate an internal carry conditionally within the 8-bit adder) in cycles 3 and 12.

The outputs (sum on bus 151 and carry out, Cout) from adder 112 of FIG. 5 are ready at the end of phase 1 of every clock cycle (although not necessarily used in all cycles). The carry-out, Cout, (overflow) is latched into latch 113 of FIG. 6 in the middle of the cycle, except in cycles 1, 5, 6, 7, 8, and 13 where the previously latched bit is left undisturbed. Whenever the carry-out (Cout) is latched, three additional bits are also latched into latch 113 for subsequent use, namely, the least significant bit (lsf-112) of the sum from adder 112; WRAM from multiplexer 136-1 of FIG. 7 indicating whether the current cycle is a memory write cycle (as opposed to a read); and, a bit selected by multiplexer 152 from RL latch 114 of FIG. 4 which when latched in cycle 4 corresponds to the $B_n$. All four latched bits are available in both true and complemented form from latch 113.

One embodiment of latch 113 of FIG. 6 uses a 74LS379 circuit triggered by the rising edge of phase 2 (enabled by AND gate 174 except during the aforementioned cycles). The outputs from latch 113 are labeled OV, LSAB, WROTE, and B respectively corresponding to the latched overflow, least significant adder bit, write, and $B_n$ described above (complementary outputs are labeled $\overline{OV}$, $\overline{LSAB}$, $\overline{WROTE}$, and $\overline{B}$).

Figure 4:
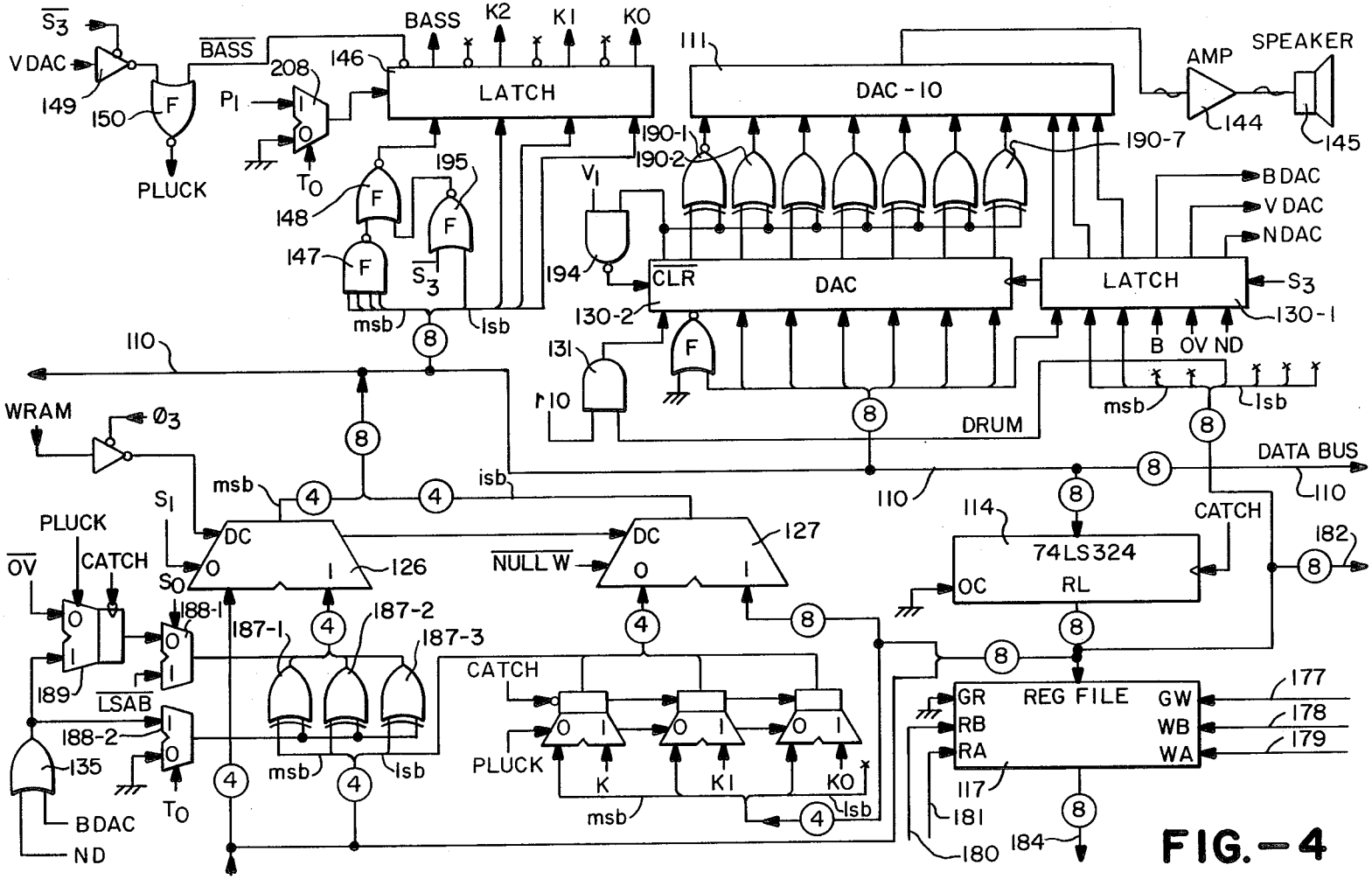
FIGS. 4, 5, 6 and 7 depict an electrical block diagram of one 16-voice embodiment of the present invention.

One of the adder 112 inputs comes from an 8-bit RL register 114 of FIG. 4, which during the time the adder is active (phase 1) contains the data which was present on the memory data bus 110 at end of phase 2 of the previous cycle (that is, the data read or written from/to memory).

Register 114 of FIG. 4 is implemented with a 74LS374 chip edge-triggered by a CATCH signal from OR gate 175 from logic 156 of FIG. 5 which rises briefly after the onset of phase 1 and also after the onset of phase 2. CATCH falls during the latter part of each phase. As an input to adder 112, the four low-order bits of RL register 114 of FIG. 4 can be replaced by four random bits via multiplexer 115 of FIG. 5 under control of NOR gate 176.

The other input to adder 112 is from buffer 116 of FIG. 5 which is derived from one of four registers, referred to as R0, R1, R2, and R3, which are maintained in a 4-word by 8-bit register file 117 in FIG. 4 (implemented using two 74lS670 chips). As an input to adder 112 these eight bits from file 117 can all be forced high (done in cycles 4 through 11) by the $\overline{HYBYT}$ signal from multiplexer 122 of FIG. 7 to form a minus one (hexadecimal FF), or the most significant bit (msb) replaced by a signal called $\overline{BASS}$ (done in cycle 3) by means of multiplexer (mux) 118 in FIG. 5 under control of the T0 signal. When the msb is replaced by $\overline{BASS}$ via mux 118, $\overline{BASS}$ is rerouted to the carry-in (Cin) input of adder 112 (after being combined with some random bits).

The value $D_J$ is maintained to a precision of 9 bits, representing a binary fraction between 0 and 1; however only 8 bits are explicitly stored in the parameter slot allocated for $D_J$ in memory. The missing bit is obtained from the $\overline{BASS}$ signal, which in turn is obtained as follows from the parameter L (number of active words in the current wavetable). If L is greater than 240, then $\overline{BASS}$ (and hence the missing $D_J$ msb) is a logical zero, otherwise it is a logical one. Thus, for L greater than 240, $D_J$ is constrained to be between 0 and $\frac{1}{2}$, whereas for L less than 241, $D_J$ is between $\frac{1}{2}$ and 1. This complication allows a doubling in the otherwise attainable pitch accuracy, while still retaining the ability to produce very-low-pitched (bass) notes. The consequent restrictions on $D_J$ (and hence also on the cut-off frequency) are not serious since for base notes a low cut-off frequency is desirable while, for higher-pitched notes a higher cut-off frequency is desirable.

Register File

The register file 117 of FIG. 4 is used as temporary storage for parameters and waveform data read from memory. On each phase of each cycle, any of the four registers $R_0$, $R_1$, $R_2$ and $R_3$ can be selected for readout from this register file 117, and another register in the file 117 can simultaneously be selected to be written into. Data which is written into the register file 117 is obtained directly from the RL register 114 of FIG. 4. The register-select bits (RA, RB, WA,WB, GR, GW) are derived from the counter bits from counter latch 119 of FIG. 7 which define which is the current cycle number, and from the current phase, by means of 74LS151 multiplexers 154 of FIG. 5 and 74LS153 multiplexers 155 of FIG. 6 together with some other control logic 156 of FIG. 5 and control logic 157 of FIG. 6.

The determination of which of the four registers in the register file 117 of FIG. 4 is to be written into during phase 1 of the given clock cycle is determined by the WAD1 and WAD0 signals, which are generated (along with their complements, $\overline{WAD1}$ and $\overline{WAD0}$) by a pair of 74LS151 circuits forming multiplexers 154-1 and 154-2 of FIG. 5 according to the number of the cycle ($S_{3,2,1,0}$ bits) and, in certain cycles, the state of the PLUCK signal through NOR gate 203. WAD1 is the most significant but (msb) and WAD0 and the least significant but (lsb) of a 2-bit binary number specifying the register number in the range 0 through 3. For example, if WAD1=1 and WAD0=0, then R2 would be specified, since 2 (decimal)=10 (binary). The register write is inhibited in the case when R1 is specified if the WROTE signal is false that is, R1 can only be written into if the preceding cycle was a memory write. This write inhibit is indicated by an assertion of the $\overline{NULLW}$ signal into multiplexer 127 of FIG. 4 from gate 197 in logic circuit 156 of FIG. 5. During phase 2, only registers R2 and R3 of file 117 can be written into, and then only if R1 was specified in phase 1 and the signals $T_2$ and $T_1$ are of opposite polarity. The equality of $T_2$ is indicated by the signal $T_2=T_1$ which is their exclusive-NOR from gate 204 of FIG. 6. Note that the "=" symbol is part of the signal name. When all the foregoing conditions are satisfied, then $S_1$ input to multiplexer 198-1 of FIG. 5 is used to choose between R2 and R3.

The determination of which register in the register filed 117 is to be read out during phase 2 is controlled by a pair of signals $\overline{RAD1}$ and $\overline{RAD0}$, which are generated by a single 74LS153 circuit forming multiplexers 155-1 and 1552-2 of FIG. 6 according to the (next) cycle number as expressed by the $T_{3,2,1,0}$ bits from counter 160-2 of FIG. 7. The values of $\overline{RAD1}$ and $\overline{RAD0}$ from multiplexer 155 of FIG. 6 encode the register number in file 117 where 11 means R0, 10 means R1, 01 means R2, and 00 also means R2. Note that R3 cannot be specified and that there are redundant codes for R2. This condition exists because R3 is never read in phase 2. The code 00 is also decoded used to cause via line 205 the storage multiplexer 123 to select in such a way so as to address that part of the memory 120 which contains parameters rather than wave samples in the next cycle. During phase 1 of the cycle, the $\overline{RADx}$ bits from multiplexers 155-1 and 155-2 are still stabilizing and are not used to specify register readout. Instead, the signal X21 (which is the XOR from gate 164 of $S_2$ with $S_1$) from logic 157 is used to choose either R2 or R3 to be read out from the register file 117, depending on $S_0$ as well in multiplexers 206 and 207 of FIG. 6. The operation makes use of register file 117 capability of simultaneously reading a register while writing another.

For a 12- or 16-voice configuration, the memory 120 is addressed via a 13-bit address bus 121 of FIG. 5. The four highest-order address bits on bus 121-1 define the current voice bits as outlined previously. Of the nine remaining bits, the bit on line 121-2 (called HYBYT) is determined by a 84LS151 multiplexer 122 of FIG. 7 according to the current cycle number. The other eight bits on lines 121-3 of FIG. 5 are output from a pair of 84LS298 chips forming storage multiplexers 123 of FIG. 5 clocked by the falling edge (end) of phase 2 ($\phi 2$) of the cycle previous to the one in which they are to be used to address the memory. This "lookahead" insures that the time necessary to determine the address bits detracts minimally from the memory access time.

The storage multiplexer 123 of FIG. 5 is connected on one input to select the readout on line 184 form the register file 117 of FIG. 4 or on the other input 185 from eight bits, of which the high-order six are logical 1's (Vcc) and the low-order two are determined by NOR gates 124 ($P_1$) and 125 ($P_0$) of FIG. 5 from the current cycle number $T_1$, $T_2$, $T_3$ and STB. The other input 185 is chosen when the memory access involves a parameter rather than a waveform sample. Addresses are held stable on the address bus 121 for the duration of each clock cycle.

In contrast to the address bus 121, the 8-bit data bus 110 of FIGS. 3, 4 and 5 generally carries different information during the two phases comprising a clock cycle. During phase 1, the data bus is sourced by a pair of 74LS257 tri-state multiplexers 128 of FIG. 4 which select either from the register-file 117 readout or from the adder 112 output. In cycles 3 and 12, the four low-order adder output bits are replaced through multiplexer 158 of FIG. 5 by the four "lost" bits. The choice of sourcing for bus 110 is made according to various conditions depending on the cycle number. During phase 2, the data bus 110 can be sourced from a variety of places. During a memory write, bus 110 is sourced from a pair of 74LS257 tri-state circuits forming multiplexers 126 and 127 of FIG. 4 which selects either RL file 117 directly or the RL output shifted, complemented, or partially replaced by multiplexers 186-1,, 186-2 and 186-3 and gates 187-1, 187-2 and 187-3 with multiplexers 188-1 and 188-2. During a memory read, bus 110 is sourced from the memory 120; and, during a parameter change, from the address register 139 of interface unit 166 of FIG. 7 with the relevant voice number (4 bits) and a 3-bit code specifying which of the eight possible parameters to change, while simultaneously loading the interface unit's data register with the desired new value for that parameter.

In a typical environment, microcomputer 173 of FIG. 7 connects to interface unit 166 of FIG. 5 (166-2) and of FIG. 7 (166-1). The microcomputer 173, under program control, outputs the desired value to an address on bus 170 for storage in register 159 which depends on the voice number and specific parameter. A 74HC688 circuit forms equality detector 129 in FIG. 7 which is used to detect a voice and parameter match during what would otherwise be a memory read for that parameter, and to substitute the new value from the microcomputer through the interface unit 166 for what would otherwise have been read from memory (such a match causes the $\overline{JAM}$ signal to be asserted from detector 129). As noted before, whatever is on the data bus 110 at the end of each phase is loaded into the RL register 14 (during phase 1 this is the only reason for placing data on the data bus). The data bus 110 is also latched at the end of cycle $7_2$ into the high-order eight bits of the DAC Latch 130-2 of FIG. 4, which feeds the DAC 111. The lower-order bits of the DAC Latch 130-1 of FIG. 4 are latched from high-order bits of RL latch 114 at this same time, as are the current values of the OV and B signals in latch 113 of FIG. 6 (which in turn were last latched in the middle of cycle 4, as described previously). The DAC Latch 130 in FIG. 4 is implemented typically as a 74LS273 circuit 130-2 together with either a 74LS174 circuit 130-1 or a 74LS374 circuit 130-1 depending on whether a 10-bit or a 12-bit DAC is desired. The 12-bit DAC yields a better signal-to-noise ratio, but is more expensive and takes up more space than the 10-bit version.

The high-order seven bits of the word sent to the DAC 111 through gates 190-1 to 190-7 can be optionally cleared or complemented if one of the two possible drum modes has been specified for that voice. The latched versions of OV and B (called VDAC and BDAC respectively) are stored in the same latch 130-1 used for the DAC Latch, but are not fed to the DAC 111. Similarly treated are the logical AND, in gate 131, of a random bit $r_{10}$ with the drum-select bit, DRUM. Another probabilistic bit called ND is a logical zero with a probability which is selectable from among 16 choices in the range 0 to $\frac{1}{2}$. ND is stored in latch 130-1 and provides the output NDAC. The ND signal is computed as the logical NAND, in gate 133 of FIG. 5, of a random bit $r_5$ (probability $\frac{1}{2}$ of being a logical one) from generator 163 of FIG. 7 with the output on line 134 of a 74LS85 circuit which forms magnitude comparator 132 in FIG. 5 and which compares the four high-order bits of the register-file 117 readout on lines 184 with four random bits $r_0/r_1$, $r_2$, $r_3$ and $r_4$. ND is only meaningful during certain cycles. During cycle $7_2$, ND defines $D_K$ which functions to act on the decay-phase pointer K (note that K only has an integer part, with no fractional part, $K=k$ with $R_K=-1$ and $v_K=-$(probability of ND being logical zero) and $D_K=u_K+v_K$. During cycle $14_1$, ND is a logical zero with a probability corresponding to the pink noise control parameter p during the note's initial excitation (pluck), which is precisely when this parameter is needed to control the harmonic content of the initial wavetable load.

Because of the delays in the register-file 117 and the magnitude comparator 129 and associated circuitry, the value of ND at the end of a particular phase persists well into the next phase before assuming its new state. ND is XORed, in gate 135 of FIG. 4, with BDAC to determine whether or not to complement the amplitude during the pluck portion of the note. The value of ND at the end of cycle $7_2$ is latched in the DAC Latch 130-1 of FIG. 4 (but not fed to the DAC) and is available for the remainder of that logic cycle under the name NDAC. NDAC is used during the decay portion of the note to decide whether to modify the wavetable or not for the current sample time. Modification is done if NDAC is a logical zero.

Whether a memory read or a memory write for memory 120 is desired is indicated by the complementary signals WRAM and $\overline{\text{WRAM}}$ from multiplexer 136-1 of FIG. 7. If WRAM is a logical one (and hence $\overline{\text{WRAM}}$ a logical zero), a write is desired, otherwise a read. WRAM is determined from the output of a 84LS153 circuit which forms multiplexer 136. Only the half 136-1 of this circuit is used for this purpose, the other half 136-2 in FIG. 5 is used to select the carry-in ($C_{in}$) to the adder 112. WRAM is selected according to the current cycle number and, in certain cycles, by various conditions such as plucking PL, or whether the wavetable should be modified or not (NDAC). However, if $\overline{\text{JAM}}$ from detector 129 of FIG. 7 is asserted and WRAM is not asserted (indicating a parameter change from the interface unit), what would otherwise have been a memory read cycle is forced by OR gate 137 and NAND gate 138 in FIG. 5 to be a memory write cycle in order to jam the new value for that parameter into the memory from the interface data register 139 of FIG. 5. At the same time, the rest of the circuit receives the new parameter just as if it had been read from memory, that is, the parameter change is "transparent" to the rest of the circuitry. Because of this transparent parameter update, the logic cycle is not slowed down by "extra" memory cycles which would otherwise have been needed to recognize and update new parameters from the interface unit.

On phase 2 of each and every cycle, the data bus 110 contains data either read from, or to be written to, the memory 120. The memory 120 bandwidth is used effectively in this embodiment. Even though no data is transferred to or from memory 120 on phase 1, this time is used to address the memory 120 (as is phase 2 also) and contributes to the time available for memory access. The memory 120 is thus kept constantly busy performing useful work. WRAM from multiplexer 136-1 and inverter 140 of FIG. 7 is latched in certain cycles into latch 113 of FIG. 6 to form the WROTE signal described earlier.

Single Logic Cycle Operation

Cycles 0–7. A detailed description of a single logic cycle, showing what happens on each of its 16 component clock cycles is described as follows.

In cycle 0, the parameter L−1 is read from memory 120 of FIG. 5 into RL register 114 of FIG. 4. L is the number of active words in the wavetable, although the parameter L−1 itself is one less than L, representing the address of the last active sample. The active part of the wavetable is 0,1,2, . . . , L−2, L−1, which is L samples.

In cycle $1_1$, RL is transferred from register 114 to R3 in register file 117 of FIG. 4 so that R3 now contains L−1. At the end of $1_2$, RL register 114 is loaded with 8 bits of the parameter $D_J$ from memory 120 of FIG. 5. The 9th bit, the msb, will be derived when needed from L as explained before.

In cycle $2_1$, RL from register 114 of FIG. 4 is transferred to R2 in register file 117 of FIG. 4 so that R2 now contains eight low-order bits of $D_J$. At the end of $2_2$, RL in register 114 is loaded with a parameter from memory 120 whose high-order four bits are the four lowest-order bits of the 12-bit pitch-phase pointer J, and whose low-order four bits encode the value of $D_K$. These are the four bits which will subsequently be sent to the magnitude comparator 132 of FIG. 5 in cycle $7_2$ to be compared with four random bits in order to determine the ND signal.

In cycle $3_1$, the adder 112 in FIG. 5 adds RL from register 114 in FIG. 4 (with its 4 lowest-order bits replaced by random bits by multiplexer 115 in FIG. 5) and R2 from register file 117 in FIG. 4 (with its msb replaced by bit $\overline{\text{BASS}}$ by multiplexer 118 in FIG. 5, which in turn is derived from L. The replaced bit is re-routed as JL from file 117 to logic circuit 141 of FIG. 5 which determines through multiplexers 191 and 136-2 of FIG. 5 the adder 112 carry-in). This addition in adder 112 forms the first part of the computation of the new $J_t$ from the old $J_{t-1}$ plus $D_J$ in accordance with Eq. (2).

At the beginning of cycle $3_2$, the (4-low-ordered reinjected) sum formed in phase 1 is loaded into RL register 114 of FIG. 4 so that it can be written into R2 of file 117 of FIG. 4 during the rest of cycle $3_2$. The overflow, $C_{out}$, from the addition by adder 112 of FIG. 5 is latched into latch 113 of FIG. 6 to form the OV and $\overline{\text{OV}}$ signals. At the end of cycle $3_2$, the eight high-order bits of J are loaded from memory 120 of FIG. 5 into RL register 114 of FIG. 4. These bits form the integer part of J and are termed j.

In cycle $4_1$, the adder 112 of FIG. 5 completes the calculation of the new J, which was begun in cycle 3, by adding RL from register 114 of FIG. 4 (now containing the 8 high order bits, j, of the old J) the $\overline{\text{OV}}$ bit latched in cycle 3, and a constant of −1 (hexadecimal FF). The latter two addends $\overline{\text{OV}}$ and −1 cancel if there was no overflow in cycle 3, thus leaving the old value of j unchanged; but if there was an overflow, then the old value of j is decremented, that is, decreased by one. If decrementing j causes it to become less than 0, then j is reset to the value L−1 held in R3 of file 117. This operation is one example of how the wavetable for a voice "wraps around" in a circular fashion. The new value of j thus computed in phase 1 is written back into memory 120 during $4_2$, and also is loaded into RL register 114 at the end of $4_2$. The occurrence of wrap-around is remembered in the OV and $\overline{\text{OV}}$ signals (latched into latch 113 of FIG. 6 according to the result of addition in phase 1). If OV is asserted, then no wrap-around occurred notwithstanding the nomenclature where a constant hexadecimal FF was added.

In cycle $5_1$, RL from register 114 in FIG. 4 is transferred to R1 in file 117 of FIG. 4 so that R1 now contains j. At the end of $5_1$, the four new low-order bits of J and the 4-bit $D_K$ code are loaded from R2 of file 117 of FIG. 4 through multiplexers 126 of FIG. 4 into RL register 114, and are then written back into memory 120 during $5_2$.

In cycle 6, R1 from file 117 of FIG. 4 is used as the low-order eight bits selected by multiplexer 123 of FIG.

5 to the memory address bus 121-3 and the HYBYT address line 121-2 from multiplexer 122 of FIG. 7 is forced to a logical zero. As a result of this operation, the low-order byte of the $i^{th}$ wavetable word $w_i$ for the current voice is read from memory 120 into RL register 114. The four high-order bits of this low-order byte of $w_i$ contain the four least significant bits of the 12-bit wave-sample, whereas the four low-order bits of this low-order byte contain the dither and drum-control codes.

In cycle 7, R1 from file 117 of FIG. 4 is again selected by multiplexer 123 of FIG. 5 to address memory 120 on bus 121-3, but this time HYBYT on line 121-2 from multiplexer 122 in FIG. 7 is forced to a logical one in order to read the high-order byte of $w_i$, that is, the eight high-order bits of the 12-bit wave-sample. These bits are latched directly from the data bus 110 at the end of $7_2$ into the DAC Latch 130-2 of FIG. 4. Other bits are latched from RL register 114 at this same time, including the logical AND, in AND gate 131 of FIG. 4, of the drum bit, DRUM, from RL register 114 with a probability-$\frac{1}{2}$ random bit, $r_{10}$. The resulting latched drum bit in latch 130-2 of FIG. 4 can be used to either clear through NAND gate 194 or complement through gates 190-1 to 190-7 the high-order seven bits of the DAC Latch 130-2 for various drum modes depending on the voice number. NDAC is latched from ND into latch 130-1 of FIG. 4 and file 117 reads out R2 in $7_2$.

At this time, half of the logic cycle is complete and the audio output J has been updated and the appropriate wave-sample sent to the DAC 111 of FIG. 4 for audible output through amplifier 144 and speaker 145. R3 in file 117 currently contains L−1, and R1 in file 117 has j.

Cycles 8–15. The remainder of the logic cycle (cycles 8–15) is done "silently" and updates the modification pointer K and performs a wavetable modification if necessary. Initial loading of the wavetable in memory 120 of FIG. 5, during the "plucking" portion of the note is also done during the second half of the logic cycle. During the first half of the logic cycle (cycles 0 through 7), the wavetable never changes, but is only read out. Wavetable changes are done during the second half of the logic cycle (cycles 8 through 15).

In cycle 8, the modification pointer K is read from memory 120 of FIG. 5 into RL register 114 of FIG. 4. During the decay (i.e., non-plucking) portion of the note, K is constrained to be strictly less than L, and L is constrained to be less than 249, and therefore a value of K greater than 247 indicates that the note is currently in the plucking phase. This condition is used by the interface unit 166-1 of FIG. 7 to initiate plucks, that is, by changing the parameter K to a value between 248 and 255 inclusive. During the plucking phase, K is not modified, the normal wavetable modification via averaging adjacent samples is not performed, and the current amplitude code and pink-noise control are used to randomly initialize the wavetable. The current amplitude code and pink-noise control are used to randomly initialize the wavetable at the sample currently pointed to by j. As j changes, more and more of the wavetable is initialized in this way. The plucking phase is automatically terminated when j "wraps around" from location 0.

In order to detect this plucking condition, during $8_2$ when the data bus 110 contains the value of K, the 5 most significant data-bus lines are ANDed together by NAND gate 147, NOR gates 148 and 195 of FIG. 4 and the result latched by a 84LS75 circuit which forms a transparent latch 146 in FIG. 4. The latched output of the most significant bits is termed BASS. The complement $\overline{\text{BASS}}$ signal is physically the same signal used to replace the msb of $D_J$ in cycle 3, except that at that time only four (not five) data bits were ANDed together and the data bus 110 then contained L−1 rather than K, so that BASS then was asserted if L was greater than 240. $\overline{\text{BASS}}$ from latch 146 of FIG. 4 is combined in NOR 150 with VDAC inverted in gate 149 in FIG. 4 (which "remembers" whether j wrapped around back in cycle 4) to form a signal called PLUCK, which when asserted, indicates that the plucking condition still persists for this voice. Until cycle 8, it is not known if a plucking condition exists or not and therefore PLUCK is a logical zero in cycles 0 through 7.

In cycle $9_1$, the adder 112 of FIG. 5 adds RL from register 114 of FIG. 4 to a constant of −1 (hexadecimal FF) with the carry-in ($C_{in}$) for adder 112 selected by multiplexer 136-2 of FIG. 5 as the NDAC signal. This operation is an attempt to decrement K, which will fail either if NDAC is a logical one (indicating no wavetable modification desired this sample) or if PLUCK is asserted (in which case the adder 112 output is not selected by multiplexer 128 due to the operation of multiplexer 196 of FIG. 5). In any case, the value of K contained in RL register 114 is loaded into R0 of file 117 during $9_1$ for possible future use. Whether cycle 9 is a memory read cycle or a memory write cycle is determined by the status of PLUCK. If PLUCK is a logical zero, then a memory write cycle is performed, otherwise a read cycle is done. The status of HYBYT from multiplexer 122 of FIG. 7 (and hence the memory address) is also determined by PLUCK. If PLUCK is a logical zero, then HYBYT is a logical one as in cycle 8, and the new value of K is written back into memory during $9_2$. The new value of K is usually the adder 112 output from $9_1$, except it is obtained from R3, that is, L−1 if K was decremented below 0 or if this sample marked the precise end of the plucking phase. The plucking phase is at an end if BASS was asserted from latch 146 of FIG. 4 but PLUCK from NOR gate 150 was disabled via VDAC. If PLUCK is enabled as a logical one, then the value of K in memory need not be changed, so HYBYT from multiplexer 122 of FIG. 7 is then a logical zero, causing a different parameter, Q, to be read from memory and latched into RL register 114 at the end of $9_2$. Q contains information useful during the plucking phase, such as the 3-bit initial amplitude code, and the 4-bit code used to specify the pink-noise control p. During the decay (non-plucking) portion of the note, Q is not read anywhere during the whole logic cycle; Q is only read (and hence can only be changed by the interface unit) during the note's plucking phase. Q also has a drum bit.

In cycle $10_1$, R1 in file 117 is loaded from RL register 114 of FIG. 4, but only if WROTE from register 113 of FIG. 6 through OR gate 197 and multiplexer 198-3 indicates that the preceding cycle (i.e.9) was a write cycle; otherwise R1 is left containing its old value, namely j. Since RL at this time contains the new value of K if a memory write did occur in cycle 9, R1 ends up either containing the new value of K (if PLUCK is not asserted) or else it has the current value of j (if PLUCK is asserted). In any case, R1 will be subsequently used to address any wavetable word which needs changing. If a wavetable modification is to be performed (during the non-plucking portion) it will be necessary to perform the operation $w_i = \frac{1}{2}(w_{i-1} + W_{i+1})$ which requires six memory cycles accessing the wavetable since each wavetable sample occupies two bytes. Cycle 10 starts these accesses by using the contents of R0 to fetch the low-order byte of $w_{k+1}$ and load it into RL register 114 at the end of $10_2$. Meanwhile in $10_1$ the adder 112 computes the value of i−1 by adding a constant of −1 (hexadecimal FF) via $\overline{HYBYT}$ into buffer 116 of FIG. 5 to RL which contains K if not PLUCKing. Note that since K has no fractional part, K=k, the result is stored in R2 at the end of $10_2$ (after temporarily saving it in RL for the duration of phase 2). Note that R0 only contains k+1 if PLUCK is a logical zero and NDAC is also logical zero, that is, if K was decremented modulo L in cycle $9_1$. If not decremented, then the value read from memory in cycle 10 will be subsequently ignored anyway, so the erroneous address does not matter. The carry-in to the adder 112 in $10_1$ is selected by multiplexer 136-2 as the PLUCK signal through operation of NOPL through multiplexer 191. If PLUCK is asserted then since in that case RL contains Q instead of K, the result is to load R2 of file 117 with the value of Q at the end of $10_2$ since the carry-in selected by multiplexer 136-2 cancels the −1 addend from buffer 116 if PLUCK is asserted. In an embodiment where M is restricted to 2, the necessary wavetable subscripts are computed by simple decrementation. Non-restricted values of M would require more complicated subscript calculations. If necessary, R3 of file 117 is used to adjust i+1 modulo L.

In cycle $11_1$ RL from register 114 of FIG. 4 is transferred to R3 of file 117 in FIG. 4 (which up to now contained L−1 and now possibly contains the low-order byte of $w_{i+1}$). At the same time, R2 from file 117 is used to address memory 120 in order to fetch the low-order byte of $W_{i-1}$, which is loaded into RL register 114 at the end of $11_2$.

In cycle $12_1$ the adder 112 of FIG. 5 adds together RL and R3, thus forming the low-order part of the sum $w_{i-1}+w_{i+1}$ (assuming both PLUCK and NDAC are logical zeroes). During this addition, the low-order four bits of RL on bus 182 are replaced by operation of multiplexer 115 in FIG. 5 on their way to the adder 112 by four random bits, roto rq, to effect the dithering. The four low-order bits of the low-order byte of all wavetable samples contain one of 16 possible dither-probability codes. The result of this addition (with the four "lost" dither bits re-injected) is written back into R3 of file 117 at the end of $12_2$ after temporary residence in RL during phase 2. Meanwhile the value in R2 of file 117 is being used to address the memory 120 to fetch the high-order byte of $w_{i-1}$, which is latched into RL register 114 at the end of $12_2$.

In cycle $13_1$ RL from register 114 is transferred to R2 in file 117, but only if not PLUCKING. Thus, if PLUCK is asserted, R2 still retains the value of Q, otherwise it receives the high-order byte of $w_{i-1}$ (assuming NDAC is a logical zero). Meanwhile the value in R0 of file 117 is used to address the memory 120 in order to fetch the high-order byte of $w_{i+1}$, which is latched into RL at the end of $13_2$.

In cycle $14_1$ the adder 112 of FIG. 5 adds together RL and R2 (along with the carry-out from the low-order addition in cycle $12_1$ selected as $\overline{OV}$ by multiplexer 136-2) to form the high-order part of the sum $w_{i-1}+w_{i+1}$ whenever PLUCK and NDAC are both logical zeroes. At the end of $14_1$, RL is loaded either from this sum from adder 112 (if not PLUCKing) or directly from R2 (if PLUCK; in that case R2 contains Q). During $14_2$, RL is used to determine the value written into the high-order byte of the wavetable word pointed to by the value in R1 as follows. If PLUCK and NDAC are both logical zeroes, then the high-order byte of $w_i$ is loaded with the value in RLon bus 182 shifted right by one bit (i.e. divided by 2) by operation of multiplexers 126 and 127 of FIG. 4 and where the msb is obtained from the carry-out ($\overline{OV}$ bit) of the addition in phase 1 through multiplexers 189 and 188-1 of FIG. 4. If PLUCK is a logical zero, but NDAC is a logical one, then the memory write is inhibited by operation of NAND gate 202 in FIG. 7, since no wavetable modification is desired in that case. If PLUCK is a logical one, then the high-order byte of $w_i$ is initialized with an 8-bit quantity whose msb is the XOR of ND with BDAC in gate 135 of FIG. 4, whose next 3 bits are either the true or complemented (according to the XOR by gates 187) 3-bit amplitude code forming a portion of Q and currently residing in RL, whose next bit is the drum bit of Q, and whose three least significant bits selected by multiplexers 186-1, 186-2 and 186-3 of FIG. 4 are the 3-bit dither code held in K2, K1, and K0 by latch 146 of FIG. 4. Whichever value is chosen (to be written to memory) is latched into RL at the end of $14_2$. If the memory write is inhibited, then RL is undefined and irrelevant.

In cycle 15, the low-order byte of the wavetable word whose high-order byte was written in cycle 14 is loaded with a value as follows. If PLUCK and NDAC are both logical zeroes, the value is obtained by shifting R3 right one bit by multiplexer 126 of FIG. 4 (except the four low-order bits are not shifted) and setting the msb to the LSAB signal by multiplexer 188-1 of FIG. 4 (last latched in the middle of cycle 14). If PLUCK is a logical one, the four low-order bits are obtained via RL from the same bits used for the high-order byte in $14_2$ (these are the drum and dither bits), while the four high-order bits are not important since they make a scarcely audible amplitude difference. The logic cycle is now complete.

Cycle Count

The counting through the sixteen cycles in a logic cycle and the cycling through all the voices is done by a 84LS393 circuit which forms counter 160 of FIG. 7, whose outputs are latched at the beginning of each clock cycle by $0_1$ (start of phase 1) by a 84LS273 circuit forming latch 119. The four low-order bits of counter latch 119 are named $S_3$, $S_2$, $S_1$, and $S_0$ and their binary value defines the number of the current cycle. For example, for cycle 5 they equal the binary code 0101. The four high-order bits are used to determine the four voice-identification bits $V_3$, $V_2$, $V_1$, and $V_0$ (after possibly being remapped if voice coalescing is specified) which form the high-order part on lines 121-2 of all addresses sent to memory 120. The reason that outputs from the counter latch 119 are used rather than from the counter directly is that the 74LS393 circuit of counter 160 is a rather slow ripple-carry counter and a considerable amount of time is needed for the carry to propagate to the high-order bits. The propagation delay would detract from the memory access time if these bits were directly used as address bits. By latching the counter outputs and then immediately instructing the counter to increment its contents, the full duration of the clock cycle is available both for the memory access and for the counter incrementation. An additional advantage of this latching scheme is that the four low-order bits from the counter can be used for "look-ahead" since during the latter part of a cycle they contain the number of the next cycle. These four low-order bits are called the T bits $T_3$, $T_2$, $T_1$, and $T_0$ and represent a binary number which is often greater than that contained in the corresponding S bits (for most of the cycle). These T bits are used in various places in the circuit where look-ahead is necessary or convenient. The higher-order $T_{4,5,6,7}$ bits from stage 160-1 take longer to stabilize and are not used for this purpose.

Random Bit Generator

The numerous probability-$\frac{1}{2}$ random bits used in various places are generated in one preferred embodiment with a conventional 16-bit feedback-shift-register (FSR) 163, which is implemented by two 74LS164 shift register circuits 161-1 and 161-2 and an $\overline{\text{XOR}}$ gate 162 of FIG. 7. The FSR 163 is clocked once per logic cycle by the $S_3$ signal. Of the sixteen bits available, eleven are used as inputs to the rest of the circuit. These FSR bits are labeled as $r_0, r_1, r_2, \ldots, r_{10}$ and are each a logical one half-the-time and a logical zero the other half, in a pseudo-random sequence. FSR's of this type have a forbidden state which is to be avoided. In this case, the forbidden state consists of all ones and provision is made for forcing the FSR out of this forbidden state by injecting zeroes in response to a reset signal, $\overline{\text{RES}}$. Because of this forbidden state, the probability of a bit being a logical zero is slightly greater than its being a logical one. These probabilities for a 16-bit FSR are 0.50000762. . . and 0.4999237. . . respectively, which are close enough to $\frac{1}{2}$ for practical purposes. There is a strong correlation between adjacent bits in adjacent clock cycles, but for any given voice sample, the correlation has been removed by the time the next sample for that voice is produced sixteen clock cycles later. Cross-voice correlation is unimportant.

The 16-voice embodiment described contains a great deal of parallelism with many different things happening at the same instant. For example, memory accesses, register reads and writes, cycle-counter decrementation, operand addition, random-number generation, digital-analog conversion, look-ahead, are all occurring concurrently. Many of these activities would have to be done sequentially in software or other implementations, and would require cuts in sampling rates, number of voices, or other performance capabilities. The preferred embodiment described does many of these things simultaneously and still manages to recognize parameter changes from the interface unit.

Parameters

The actual mechanics of parameter changes has already been described above and this section concentrates on the parameters themselves, their encodings, and their meanings. Each of the eight parameters is given a number from 0 to 7, whose 3-bit binary representation corresponds to three bits on the address bus when that particular parameter is being accessed. The least significant bit (lsb) corresponds to the HYBYT address line 121-2 and the other two bits correspond to the low-order two bits of lines 121-3 output by the storage multiplexer 123 except that parameters #2 and #3 have no specific address in memory and are dependent on the value of "j". The following TABLE 1 lists and identifies the eight parameters, and the cycle number where each is read.

TABLE 1

| Parameter # Octal | Parameter # Binary | | Cycle # (Decimal) | Parameter Name and/or Description |
|---|---|---|---|---|
| $0_8$ | $000_2$ | | $2_{10}$ | J-j, fraction part of J; 4-bit $D_K$ code "DK" |
| $1_8$ | $001_2$ | | $3_{10}$ | j, the integer part of pitch-phase pointer J |
| $2_8$ | $010_2$ | | $6_{10}$ | low-order byte of $w_i$ |
| $3_8$ | $011_2$ | | $7_{10}$ | high-order byte of $w_i$ |
| $4_8$ | $100_2$ | (PLUCK) only | $9_{10}$ | Q, initial amplitude, pink-noise code, drum bit |
| $5_8$ | $101_2$ | | $8_{10}$ | K, decay-phase pointer |
| $6_8$ | $110_2$ | | $0_{10}$ | L-1, active wave-buffer length minus one |
| $7_8$ | $111_2$ | | $1_{10}$ | DJ, 8-bit partial code for 9-bit $D_J$ |

Certain parameters (#'s $0_8$, $1_8$, $2_8$, $3_8$, and $5_8$) are modified in the normal course of a logic cycle, while others (#'s $4_8$, $6_8$, and $7_8$) are not. These latter can only be changed by means of the interface unit 166, whereas specifying any of the former in the interface unit 166 will result in the value held in the interface unit overriding any internal modifications for as long as it is held there (that is, until the next command is given to the interface unit). Any parameter change must be held in the interface unit 166 for at least as long as it takes to cycle once through all the voices (approximately 36 microseconds at the maximum clock rate of 7.16 MHz) in order to insure that the parameter change is honored.

The 3-bit code used in the interface unit 166 to specify a parameter is the cycle # of TABLE 1 except that cycle $\#8_{10}$ is encoded as a $4_{10}$ and cycle $\#9_{10}$ is encoded as a $5_{10}$. As mentioned before, only eight bits of $D_J$ are explicitly stored in memory, as parameter $\#7_8$. If these eight bits are called DJ, the following TABLE 2 shows how the 9-bit binary fraction which is $D_J$ is derived from DJ, $\overline{\text{BASS}}$, and a probability-$\frac{1}{2}$ random bit. In the example of TABLE 2, $\overline{\text{BASS}}$ is assumed to be a logical one, and DJ a decimal $74_{10}$.

TABLE 2

| | | |
|---|---|---|
| DJ: | $01001010_2$ | = hexadecimal $4A_{16}$ = decimal $74_{10}$ |
| $\overline{\text{BASS}}$ | $110010100_2$ | |
| | $+\frac{1}{2}$ | (random bit) |
| effective $D_J$: | $.110010101\frac{1}{2}$ | = 809/1024 = approx. 79% |

In TABLE 2, the note's cut-off frequency would be 79% of its maximum possible value of $f_s/2$.

As mentioned before, Q consists of a 3-bit amplitude code, a drum bit, and a 4-bit pink-noise probability code. These eight bits divided into a high-order nybble (nybble=4 bits) containing the amplitude and drum bits, and a low-order nybble encoding the pink-noise probability, p, according to the following TABLE 3.

TABLE 3

| Nybble Hex | Nybble Binary | High-order Amplitude | High-order Drum | Low-order Pink-noise probability p |
|---|---|---|---|---|
| | | (quietest) | | ("dolce") |
| 0 | 0000 | 0 | No | 0 |
| 1 | 0001 | 0 | Yes | 1/64 |
| 2 | 0010 | 1 | No | 2/64 |
| 3 | 0011 | 1 | Yes | 3/64 |
| 4 | 0100 | 2 | No | 4/64 |
| 5 | 0101 | 2 | Yes | 5/64 |
| 6 | 0110 | 3 | No | 6/64 |

TABLE 3-continued

| Nybble | | High-order | | Low-order |
|---|---|---|---|---|
| Hex | Binary | Amplitude | Drum | Pink-noise probability p |
| 7 | 0111 | 3 | Yes | 7/64 |
| 8 | 1000 | 4 | No | 8/64 (note break) |
| 9 | 1001 | 4 | Yes | 11/64 |
| A | 1010 | 5 | No | 14/64 |
| B | 1011 | 5 | Yes | 17/64 |
| C | 1100 | 6 | No | 20/64 |
| D | 1101 | 6 | Yes | 23/64 |
| E | 1110 | 7 | No | 26/64 |
| F | 1111 | 7 (loudest) | Yes | 29/64 ("metallico") |

For example if Q had the value $4B_{16}$, this value would specify amplitude level 2, no drum, from $4_{16}$ and pink-noise probability p=17/64 from $B_{16}$. Any parameter change involving Q for a particular voice is honored only if the voice is currently in the plucking condition, which as pointed out before is indicated by a K value greater than 247. The exact value of K used to initiate plucking will determine the eventual dither probability in conjunction with the (ultimate) drum status as follows in TABLE 4:

TABLE 4

| Value of K | | Dither Probability | |
|---|---|---|---|
| Hex | Decimal | Drum Off | Drum On |
| F8 | 248 | 0 | 8/16 |
| F9 | 249 | 1/16 | 9/16 |
| FA | 250 | 2/16 | 10/16 |
| FB | 251 | 3/16 | 11/16 |
| FC | 252 | 4/16 | 12/16 |
| FD | 253 | 5/16 | 13/16 |
| FE | 254 | 6/16 | 14/16 |
| FF | 255 | 7/16 | 15/16 |

Note that dither probabilities are symmetric about $\frac{1}{2}$ as explained previously.

By the time the decay portion of the note is begun, the drum and dither codes specified during the pluck have been transferred to the low-order 4 bits of the low-order byte of each sample word in the wavetable. If so desired, these bits can be altered on a sample-by-sample basis during the decay portion by requesting the interface unit to change parameter $\#2_8$, thus allowing a continuous "blending" between the drum and non-drum modes. It should be noted that the drum mode for certain voice numbers produces an unpitched drum, while in contrast for other voices a pitched drum is produced. Voice bit $V_1$ is used for this purpose.

The 4 low-order bits of parameter $\#0_8$ contain the DK code nybble which determines the probability of modification of a given sample (and hence the decay rate) according to the following TABLE 5:

TABLE 5

| DK code nybble (Hexadecimal) | Modification probability (Decimal; = $-v_K$) | Stretch Factor (Decimal; = $-1/v_K$) | Relative to DK = 8 (Approx. decimal % |
|---|---|---|---|
| 0 | 0 | infinite | infinite |
| 1 | 1/64 | 64. | 800% |
| 2 | 2/64 | 32. | 400% |
| 3 | 3/64 | 21.333 | 267% |
| 4 | 4/64 | 16. | 200% |
| 5 | 5/64 | 12.8 | 160% |
| 6 | 6/64 | 10.667 | 133% |
| 7 | 7/64 | 9.143 | 114% |
| 8 | 8/64 | 8. | 100% |
| 9 | 11/64 | 5.818 | 73% |

TABLE 5-continued

| DK code nybble (Hexadecimal) | Modification probability (Decimal; = $-v_K$) | Stretch Factor (Decimal; = $-1/v_K$) | Relative to DK = 8 (Approx. decimal % |
|---|---|---|---|
| A | 14/64 | 4.571 | 57% |
| B | 17/64 | 3.765 | 47% |
| C | 20/64 | 3.2 | 40% |
| D | 23/64 | 2.783 | 35% |
| E | 26/64 | 2.462 | 31% |
| F | 29/64 | 2.207 | 28% |

The last column relates the duration of a note to that of a "nominal" one using a DK code of 8 (a good value to use when simulating a real guitar). It can be seen that this nominal duration can either be stretched or shortened a considerable amount. DK can, of course, be varied during the decay itself to produce, for example, a note with a fast initial decay and a slow final decay. A waveform can be "frozen" at any time by selecting a DK code of 0 (eliminates all wavetable modification). Since they share the same parameter #, changing DK also causes a change in J-j; however, this is not a problem as long as such changes are made at a rate slower than the note's fundamental frequency, and the parameter is not held in the interface unit for longer than necessary to effect each change.

Changing parameter #1 is useful for arbitrarily setting the phase of the output waveform, as well as pointing at a particular location in the wavetable (for example, in order to be able to force something into that location using parameter #3). This would usually be done just prior to a pluck command in order to avoid premature termination of the plucking phase because of possible imminent wrap-around of j. It can also be used to produce "partial plucks" by controlling how much of the wavetable is to be initialized (for example, if L is 120, j could be set to 30 just prior to setting K to say 250 in order to initialize only one-fourth of the active wavetable).

The initial excitation can be accomplished without ever entering the plucking condition simply by force-feeding samples into the wavetable "on the fly" using carefully timed changes of parameter #'s 1, 2, and 3. Usually parameter #7 (DJ) would be cleared before this operation to avoid interference with the j values (it would be set to the desired value after the wavetable load is completed). However an alternate loading method makes use of the normal movement in j caused by DJ to step through the table. This method requires DJ to be set in such a way to decrement at the same rate that samples are sent to the interface unit for loading. The advantage of this loading scheme is that it is fast, since only a single parameter (#3) need be changed for each sample. Of course if random excitation is satisfactory (it produces very credible sounds, especially with judicious use of the pink-noise control), the normal plucking mechanism can be used, which only requires a few commands to be sent to the interface unit.

While the invention has been particularly shown and described with reference to preferred embodiments thereof, it will be understood by those skilled in the art that the foregoing and other changes in form and detail may be made therein without departing from the spirit and scope of the invention.

I claim:

1. A musical instrument comprising, input means for specifying music to be generated, wavetable generator means for repeatedly generating digital samples of music, each of said samples representing a music component having a short duration relative to the periods of tones forming said music, said generator means including, wavetable means for storing a plurality of said samples in wavetable locations, sample generator means including modifier means for repeatedly modifying one or more of said samples to provide repeatedly a first sample as one of said samples, first means for repeatedly pointing to a first one of said wavetable locations to store repeatedly said first sample, second means for repeatedly pointing to a second one of said wavetable locations to provide repeatedly from said samples a second sample as an audio output signal, access means operating independently in response to said first means and said second means to access repeatedly said wavetable locations whereby the access for said first sample is made independently of the access for said second sample, said access means operating repeatedly to access said second sample at a frequency $f_s$ to provide said music.

2. The musical instrument of claim 1 wherein said first means includes first pointer means providing a first pointer, $K_t$, for pointing to said first one of said locations, and includes operator means for modifying said first pointer with an operator, $D_K$, at a first frequency, $f_K$, and wherein said second means includes second pointer means providing a second pointer, $J_t$, for pointing to said second one of said wavetable locations and includes second operator means for modifying said second pointer with an operator, $D_J$, at a second frequency, $f_J$, whereby said first and second pointers are independently changeable.

3. The musical instrument of claim 1 wherein said first means includes a first pointer, $K_t$, for pointing to said first one of said locations, and includes operator means for periodically modifying said first pointer with a first operator and wherein said second means includes a second pointer, $J_t$, for pointing to said second one of said wavetable locations and includes operator means for perodically modifying said second pointer with a second operator whereby said first and second pointers are independently changeable.

4. A musical instrument comprising, input means for specifying music to be generated, wavetable generator means for generating digital samples of music, said generator means including, wavetable means for storing a plurality of samples in wavetable locations, sample generator means including modifier means for modifying one or more of said samples to provide a first sample, first means for pointing to a first one of said wavetable locations to store said first sample, said first means including a first pointer, $K_t$, for pointing to said first one of said locations, second means for pointing to a second one of said wavetable locations to provide a second sample as an audio output signal, said second means including a second pointer, $J_t$, for pointing to said second one of said wavetable locations, operator means for periodically modifying said first pointer with a first operator and for periodically modifying said second pointer with a second operator whereby said first and second pointers are independently changeable, said operator means including common operator means for generating said first and second operators as $D_X^*$, said common operator means including means for randomly generating a number, $(u_X)_t$, uniformly distributed in the range 0 to $R_X$, where $R_X$ is some number with absolute value less than or equal to one, and said common operator means including means for generating a non-random number, $(v_X)_t$, as a fraction between 1 and 0 or 0 and $-1$ whereby $D_X=(u_X)_t+(v_X)_t$ and the operation of $D_X^*$ upon X is described as follows:

$$X_t=D_X^*(X_{t-1})=X_{t-1}+(u_X)_{t-1}+(v_X)_{t-1}$$

and wherein said common operator means includes means for letting X equal to K for said first operator and equal to J for said second operator, access means operating independently in response to said first means and said second means to access said wavetable locations whereby the access for said first sample is made independently of the access for said second sample.

5. The musical instrument of claim 2 further including means for providing $f_s$, $f_J$ and $f_K$ all equal.

6. The musical instrument of claim 4 wherein there are L locations in said wavetable for storing samples, wherein the values of data stored in said L locations are $w_i$ where i ranges from 0 to $L-1$, wherein said first pointer $K_t$ points to one of said locations 0 through $L-1$ and wherein said second pointer $J_t$ points to one of said locations 0 through $L-1$, wherein said first operator, $D_K$, operates upon $K_t$ at frequency $f_K$ to change at times the particular one of said locations pointed to by $K_t$ and wherein said second operator, $D_J$, operates on $J_t$ at frequency $f_J$ to change at times the particular one of the locations 0 through $L-1$ pointed to by $J_t$.

7. The musical instrument of claim 6 further including means for truncating $X_{t-1}+(u_X)_{t-1}+(v_X)_{t-1}$ to a finite precision with an integer part adjusted modulo L into the range 0 to $L-1$.

8. The musical instrument of claim 4 wherein said first pointer means includes means for generating $(u_J)_{t-1}$ as a randomly generated number uniformly distributed in the range 0 to $R_J$, where $R_J$ is a number with absolute value less than or equal to one; said first pointer means includes means for generating $(v_J)_{t-1}$ as a non-random number as a fraction between 1 and 0 or 0 and $-1$ and said first pointer means includes adder means for adding $J_{t-1}$, $(u_J)_{t-1}$, and $(v_J)_{t-1}$ whereby $J_t$ is formed as follows:

$$J_t=D_J^*(J_{t-1})=J_{t-1}+(u_J)_{t-1}+(v_J)_{t-1}.$$

9. The musical instrument of claim 8 wherein said first pointer means includes means for generating $J_t$ with an integer part, $j_t$, and wherein the integer part, $j_t$, of $J_t$ points to the wavetable location of the data $w_i$ to provide said output signal.

10. The musical instrument of claim 4 wherein said second pointer means includes means for generating $(u_K)_{t-1}$ as a randomly generated number uniformly distributed in the range 0 to $R_K$, where $R_K$ is a number with absolute value less than or equal to one; said second pointer means includes means for generating $(v_K)_{t-1}$ as a non-random number as a fraction between 1 and 0 or 0 and $-1$; and said second pointer means includes adder means for adding $K_{t-1}$, $(u_K)_{t-1}$, and $(v_K)_{t-1}$ whereby $K_t$ is formed as follows:

$$K_t = D_J^*(K_{t-1}) = K_{t-1} + (u_K)_{t-1} + (v_K)_{t-1}.$$

11. The musical instrument of claim 10 wherein said second pointer means includes means for generating $K_t$ with an integer part, $k_t$, and wherein the integer part $k_t$ points to the wavetable location of the data $w_i$ receiving the modified value.

12. The musical instrument of claim 11 wherein $K_{t-1}$ includes an integer part $k_{t-1}$ and said instrument further includes means for comparing $k_t$ and $k_{t-1}$ to provide an update signal if the new integer part, $k_t$, is different from the old integer part, $k_{t-1}$, said access means storing said first sample to modify the wavetable data only when said update signal is provided.

13. The musical instrument of claim 6 wherein said operator means includes means for modifying $w_i$, if $D_K$ tends to increase $K_t$, as follows:

$$w_i = (1-1/M)w_{i-1} + (1/M)w_{i+M-1}$$

where,

M=an integer greater than 0.

14. The musical instrument of claim 6 wherein said operator means includes means for modifying $w_i$, if $D_K$ tends to decrease $K_t$, as follows:

$$w_i = (1-1/M)w_{i+1} + (1/M)w_{i+1-M}$$

where,

M=an integer greater than 0.

15. The musical instrument of claim 6 wherein said operator means includes means for modifying $w_i$, if $D_K$ tends to increase $K_t$, as follows:

$$w_i = w_{i-1} - (w_{i-1} - w_{i+2^m-1})/2^m$$

where:

m=integer greater than 0.

16. The musical instrument of claim 6 wherein said operator means includes means for modifying $w_i$, if $D_K$ tends to decrease $K_t$, as follows:

$$w_i = w_{i+1} - (w_{i+1} - w_{i+1-2^m})/2^m$$

where:

m=integer greater than 0.

17. The musical instrument of claim 15 wherein m equals one whereby $w_i = (\frac{1}{2})(w_{i+1} + W_{i-1})$.

18. The musical instrument of claim 16 wherein m equals one whereby $w_i = (\frac{1}{2})(w_{i+1} + W_{i-1})$.

19. The musical instrument of claim 15 including shifter means for division by $2^m$ and including means for rounding $w_i$ to the nearest integer value.

20. The musical instrument of claim 16 including shifter means for division by $2^m$ and including means for rounding $w_i$ to the nearest integer value.

21. The musical instrument of claim 19 including random generator means for controlling said means for rounding $w_i$ to the nearest integer value.

22. The musical instrument of claim 20 including shifter means for division by $2^m$ and including random generator means for rounding $w_i$ to the nearest integer value.

23. The musical instrument of claim 6 wherein said first operator means includes means for making $K_t$ equal $K_{t-1}+D_K$ where $K_t$ includes an integer $k_t$ and $K_{t-1}$ includes an integer $k_{t-1}$, said first operator means having means for controlling $D_K$ such that $k_t$ does not differ from $k_{-1}$ each period $1/f_K$ by more than 1 whereby the decay rate of the output signal is proportional to $M(M-1)D_K/L^3$ where M is an integer greater than 0.

24. The musical instrument of claim 13 wherein M is greater than 1.

25. The musical instrument of claim 14 wherein M is greater than 1.

26. The musical instrument of claim 6 further including a random number generator for generating a random number operator, $R_z^*$, and control means for generating a control operator, $B_z^*$, and wherein said sample generator means includes means for initializing the wavetable values, $w_i$, where i is equal to 0, 1, . . . , (L−1) in accordance with the following equation:

$$w_i = A(R_{zi}^*)(B_{zi}^*)$$

where:

A=amplitude $R_{zi}^* = A+1$ or $-1$ as a function of random number operator, $R_z^*$ $B_{zi}^* = +1$ or $-1$ as a function of a control operator, $B_z^*$.

27. The musical instrument of claim 26 wherein said control means for generating the control operator, $B_z^*$ includes means responsive to the value of L to determine $B_z^*$ where the value of L for any voice is expressed in binary form by the binary bits n0, n1, . . . , n7 so that L is given as follows:

$$L = 2^0(n0) + 2^1(n1) +, \ldots, +2^7(n7)$$

whereby the control operator $B_z^*$ selects the value of +1 or −1 as a function of the value of the logical 1 or logical 0 value of one of the bits n0 through n7.

28. The musical instrument of claim 26 including means for determing the probability, p, of $R_{zi}^*$ being +1 or −1.

29. The musical instrument of claim 28 including means for determining $p=\frac{1}{2}$ whereby the result is white noise of amplitude A.

30. The musical instrument of claim 28 including means for determining p=0 whereby a deterministic square wave $-AB_n$ results having the most energy concentrated in the lower harmonics where the $q_{th}$ harmonic has amplitude bounded by 1/q.

31. The musical instrument of claim 28 including means for determining p with greater than eight values ranging between 0 and $\frac{1}{2}$ thereby providing a range of timbral characteristic.

32. A musical instrument comprising, input means for specifying music to be generated, wavetable generator means for generating digital samples of music, said generator means including, wavetable means for storing a plurality of samples in wavetable locations, sample generator means including modifier means for modifying one or more of said samples to provide a first sample, first means for pointing to a first one of said wavetable locations to store said first sample, second means for pointing to a second one of said wavetable locations to provide a second sample as an audio output signal, access means operating independently in response to said first means and said second means to access said wavetable locations whereby the access for said first sample is made independently of the access for said second sample, means for probabilistically determing the second sample value.

33. A musical instrument comprising, input means for specifying music to be generated, wavetable generator means for generating digital samples of music each of said samples representing a music component having a short duration relative to the periods of tones forming said music, for each voice g of a plurality, G, of voices, said generator means including for each voice, wavetable means for storing a plurality of said samples in wavetable locations, sample generator means including modifier means for repeatedly modifying one or more of said samples to provide repeatedly a first sample as one of said samples, first means for repeatedly pointing to a first one of said wavetable locations to store repeatedly said first sample, second means for repeatedly pointing to a second one of said wavetable locations to provide repeatedly from said samples a second sample as an audio output signal, access means operating independently in response to said first means and said second means to access repeatedly said wavetable locations whereby the access for said first sample is made independently of the access for said second sample, said access means operating repeatedly to access said second sample at a frequency $f_s$ whereby said music is generated from many of said second samples, output means for receiving said second sample for providing an audio output.

34. The musical instrument of claim 33 wherein said first means includes a first pointer means providing a first pointer, $K_t$, for pointing to said first one of said locations, and includes operator means for modifying said first pointer with an operator, $D_K$, at a first frequency, $f_K$, and wherein said second means includes second pointer means providing a second pointer, $J_t$, for pointing to said second one of said wavetable locations and includes second operator means for modifying said second pointer with an operator, $D_J$, at a second frequency, $f_J$, whereby said first and second pointers are independently changeable.

35. The musical instrument of claim 33 wherein said first means includes a first pointer, $K_t$, for pointing to said first one of said locations, and includes operator means for periodically modifying said first pointer with a first operator and wherein said second means includes a second pointer, $J_t$, for pointing to said second one of said wavetable locations and includes operator means for periodically modifying said second pointer with a second operator whereby said first and second pointers are independently changeable.

36. The musical instrument of claim 35 wherein said operator means includes common operator means for generating said first and second operators as $D_X^*$, said common operator means including means for randomly generating a number, $(u_X)_t$, uniformly distributed in the range 0 to $R_X$, where $R_X$ is some number with absolute value less than or equal to one, and said common operator means including means for generating a non-random number, $(v_X)_t$, as a fraction between 1 and 0 or 0 and $-1$ whereby $D_X=(u_X)_t+(v_X)_t$ and the operation of $D_X^*$ upon X is described as follows:

$$X_t=D_X^*(X_{t-1})=X_{t-1}+(u_X)_{tA-1}+(v_X)_{t-1}$$

and wherein said common operator means includes means for letting X equal to K for said first operator and equal to J for said second operator.

37. The musical instrument of claim 34 further including means for providing $f_s$, $f_J$ and $f_K$ all equal.

38. The musical instrument of claim 36 wherein there are L locations in said wavetable for storing samples, wherein the values of data stored in said L locations are $w_i$ where i ranges from 0 to $L-1$, wherein said first pointer $K_t$ points to one of said locations 0 through $L-1$ and wherein said second pointer $J_t$ points to one of said locations 0 through $L-1$, wherein said first operator, $D_K$, operates upon $K_t$ at frequency $f_K$ to change at times the particular one of said locations pointed to by $K_t$ and wherein said second operator, $D_J$, operates on $J_t$ at frequency $f_J$ to change at times the particular one of the locations 0 through $L-1$ pointed to by $J_t$.

39. The musical instrument of claim 38 further including means for truncating $X_{t-1}+(u_X)_{t-1}+(v_X)_{t-1}$ to a finite precision with an integer part adjusted modulo L into the range 0 to $L-1$.

40. The musical instrument of claim 34 wherein said first pointer means includes means for generating $(u_J)_{t-1}$ as a randomly generated number uniformly distributed in the range 0 to $R_J$, where $R_J$ is a number with absolute value less than or equal to one; said first pointer means includes means for generating $(v_J)_{t-1}$ as a non-random number as a fraction between 1 and 0 or 0 and $-1$ and said first pointer means includes adder means for adding $J_{t-1}$, $(u_J)_{t-1}$, and $(v_J)_{t-1}$ whereby $J_t$ is formed as follows:

$$J_t=D_J^*(J_{t-1})=J_{t-1}+(u_J)_{t-1}+(v_J)_{t-1}.$$

41. The musical instrument of claim 40 wherein said first pointer means includes means for generating $J_t$ with an integer part, $j_t$, and wherein the integer part, $j_t$, of $J_t$ points to the wavetable location of the data $w_i$ to provide said output signal.

42. The musical instrument of claim 34 wherein said second pointer means includes means for generating $(u_K)_{t-1}$ as a randomly generated number uniformly distributed in the range 0 to $R_K$, where $R_K$ is a number with absolute value less than or equal to one; said second pointer means includes means for generating $(v_K)_{t-1}$ as a non-random number as a fraction between 1 and 0 or 0 and $-1$; and said second pointer means includes adder means for adding $K_{t-1}$, $(u_K)_{t-1}$, and $(v_K)_{t-1}$ whereby $K_t$ is formed as follows:

$$K_t=D_J^*(K_{t-1})=K_{t-1}+(u_K)_{t-1}+(v_K)_{t-1}.$$

43. The musical instrument of claim 42 wherein said second pointer means includes means for generating $K_t$ with an integer part, $k_t$, and wherein the integer part $k_t$ points to the wavetable location of the data $w_i$ receiving the modified value.

44. The musical instrument of claim 43 wherein $K_{t-1}$ includes an integer part $k_{t-1}$ and said instrument further includes means for comparing $k_t$ and $k_{t-1}$ to provide an update signal if the new integer part, $k_t$, is different from the old integer part, $k_{t-1}$, said access means storing said first sample to modify the wavetable data only when said update signal is provided.

45. The musical instrument of claim 38 wherein said operator means includes means for modifying $w_i$, if $D_K$ tends to increase $K_t$, as follows:

$$w_i=(1-1/M)w_{i-1}+(1/M)w_{i+M-1}$$

where,

M=an integer greater than 0.

46. The musical instrument of claim 38 wherein said operator means includes means for modifying $w_i$, if $D_K$ tends to decrease $K_t$, as follows:

$$w_i=(1-1/M)w_{i+1}+(1/M)w_{i+1-M}$$

where,

M=an integer greater than 0.

47. The musical instrument of claim 38 wherein said operator means includes means for modifying $w_i$, if $D_K$ tends to increase $K_t$, as follows:

$$w_i=w_{i-1}-(w_{i-1}-w_{i+2^m-1})/2^m$$

where:

m=integer greater than 0.

48. The musical instrument of claim 38 wherein said operator means includes means for modifying $w_i$, if $D_K$ tends to decrease $K_t$, as follows:

$$w_i=w_{i+1}-(w_{i+1}-w_{i+1-2^m})/2^m$$

where:

m=integer greater than 0.

49. The musical instrument of claim 47 wherein m equals one whereby $w_i=(\frac{1}{2})(w_{i+1}+W_{i-1})$.

50. The musical instrument of claim 48 wherein m equals one whereby $w_i=(\frac{1}{2})(w_{i+1}+W_{i-1})$.

51. The musical instrument of claim 47 including shifter means for division by $2^m$ and including means for rounding $w_i$ to the nearest integer value.

52. The musical instrument of claim 48 including shifter means for division by $2^m$ and including means for rounding $w_i$ to the nearest integer value.

53. The musical instrument of claim 51 including random generator means for controlling said means for rounding $w_i$ to the nearest integer value.

54. The musical instrument of claim 52 including shifter means for division by $2^m$ and including random generator means for rounding $w_i$ to the nearest integer value.

55. The musical instrument of claim 38 wherein said first operator means includes means for making $K_t$ equal $K_{t-1}+D_{K\ where\ Kt}$ includes an integer $k_t$ and $K_{t-1}$ includes an integer $k_{t-1}$, said first operator means having means for controlling $D_K$ such that $k_t$ does not differ from $k_{t-1}$ each period $1/f_K$ by more than 1 whereby the decay rate of the output signal is proportional to $M(M-1)D_K/L^3$ where M is an integer greater than 0.

56. The musical instrument of claim 45 wherein M is greater than 1.

57. The musical instrument of claim 46 wherein M is greater than 1.

58. The musical instrument of claim 38 further including a random number generator for generating a random number operator, $R_z$*, and control means for generating a control operator, $B_z$* and wherein said sample generator means includes means for initializing the wavetable values, $w_i$, where i is equal to 0, 1, . . . , (L−1) in accordance with the following equation:

$$w_i=A(R_{zi}0)(B_{zi}^*)$$

where:

A=amplitude $R_{zi}^*=+1$ or $-1$ as a function of random number operator, $R_z$*

$B_{zi}^*=+1$ or $-1$ as a function of a control operator, $B_z$*.

59. The musical instrument of claim 58 wherein said control means for generating the control operator, $B_z$* includes means responsive to the value of L to determine $B_z$* where the value of L for any voice is expressed in binary form by the binary bits n0, n1, . . . , n7 so that L is given as follows:

$$L=2^0(n0)+2^1(n1)+, \ldots, +2^7(n7)$$

whereby the control operator $B_z$* selects the value of +1 or −1 as a function of the value of the logical 1 or logical 0 value of one of the bits n0 through n7.

60. The musical instrument of claim 58 including means for determing the probability, p, of $R_{zi}$* being +1 or −1.

61. The musical instrument of claim 60 including means for determining $p=\frac{1}{2}$ whereby the result is white noise of amplitude A.

62. The musical instrument of claim 60 including means for determining p=0 whereby a deterministic square wave $-AB_n$ results having the most energy concentrated in the lower harmonics where the $q^{th}$ harmonic has amplitude bounded by 1/q.

63. The musical instrument of claim 60 including means for determining p with greater than eight values ranging between 0 and $\frac{1}{2}$ thereby providing a range of timbral characteristic.

64. A musical instrument comprising, input means for specifying music to be generated, wavetable generator means for generating digital samples of music for each voice g of a plurality, G, of voices, said generator means including for each voice, wavetable means for storing a plurality of samples in wavetable locations, sample generator means including modifier means for modifying one or more of said samples to provide a first sample, first means for pointing to a first one of said wavetable locations to store said first sample, second means for pointing to a second one of said wavetable locations to provide a second sample as an audio output signal, access means operating independently in response to said first means and said second means to access said wavetable locations whereby the access for said first sample is made independently of the access for said second sample.

output means for receiving said second sample for providing an audio output, means for probabilistically determing the second sample value.

65. A musical instrument comprising, input means for specifying music to be generated, wavetable generator means for generating digital samples of music for each voice g of a plurality, G, of voices, said generator means including for each voice, wavetable means for storing a plurality of samples in wavetable locations, sample generator means including modifier means for modifying one or more of said samples to provide modified first samples at a frequency, $f_m$, first means for pointing at a frequency, $f_k$, to a first one of said wavetable locations to store said first samples, second means for pointing at a frequency, $f_j$, to a second one of said wavetable locations to provide second samples, access means operating independently in response to said first means and said second means to access said wavetable locations whereby the access for said first sample is made at a frequency, $f_k$, independently of the access for said second sample at a frequency, $f_j$, output means for receiving said second samples for providing an audio output at a frequency, $f_s$.

66. The musical instrument of claim 65 including random generator means for providing a random component to $f_m$, $f_k$, and $f_j$.

* * * * *